US011594127B1

(12) United States Patent
Mulligan et al.

(10) Patent No.: US 11,594,127 B1
(45) **Date of Patent: *Feb. 28, 2023**

(54) SYSTEMS, METHODS, AND DEVICES FOR COMMUNICATION BETWEEN TRAFFIC CONTROLLER SYSTEMS AND MOBILE TRANSMITTERS AND RECEIVERS

(71) Applicant: Applied Information, Inc., Suwanee, GA (US)

(72) Inventors: Bryan Patrick Mulligan, Suwanee, GA (US); Iain Jeffrey Mulligan, Alpharetta, GA (US)

(73) Assignee: Applied Information, Inc., Suwanee, GA (US)

( * ) Notice: Subject to any disclaimer, the term of this patent is extended or adjusted under 35 U.S.C. 154(b) by 35 days.

This patent is subject to a terminal disclaimer.

(21) Appl. No.: 17/101,902

(22) Filed: Nov. 23, 2020

Related U.S. Application Data

(63) Continuation of application No. 16/272,803, filed on Feb. 11, 2019, now Pat. No. 11,069,234.
(Continued)

(51) Int. Cl.
*G08G 1/087* (2006.01)
*G08G 1/01* (2006.01)
(Continued)

(52) U.S. Cl.
CPC ..... *G08G 1/087* (2013.01); *G08G 1/012* (2013.01); *G08G 1/0116* (2013.01);
(Continued)

(58) Field of Classification Search
CPC ..... G08G 1/087; G08G 1/0116; G08G 1/012; G08G 1/0141; G08G 1/091; G08G 1/095
See application file for complete search history.

(56) References Cited

U.S. PATENT DOCUMENTS 4,101,191 A 7/1978 Gould
5,153,525 A 10/1992 Hoekman et al.
(Continued)

FOREIGN PATENT DOCUMENTS

CN 202049621 U 11/2011
CN 107967818 A 4/2018
(Continued)

OTHER PUBLICATIONS

Chavan, et al., "Design of intelligent traffic light controller using embedded system", Emerging Trends in Engineering and Technology (ICETET), pp. 1086-1091 Dec. 16, 2009.
Talas et al., "Connected Vehicle Challenges for the Dense Urban Environment", Institute of Transportation Engineers, ITE Journal, 88.12:30-35, Dec. 2018.
(Continued)

*Primary Examiner* — Hussein Elchanti
(74) *Attorney, Agent, or Firm* — Morris, Manning & Martin, LLP; Daniel E. Sineway, Esq.; Daniel T. Begasse

(57) ABSTRACT

Systems, methods, and devices are disclosed for improving traffic safety and efficiency. The system includes various signal transmitters and receivers positioned throughout roadways, within automobiles, in smartphones, or supported by a cellular network backbone, for distributing traffic related information to users and traffic controller equipment. Embodiments of the present disclosure allow for vehicles and/or pedestrians to initiate a dual-transmission of cellular and RF signals for changing a traffic light state, where the first signal received at a traffic intersection controller unit is processed for changing the traffic light state (e.g., changing a light from red to green on-demand). Other embodiments of the present disclosure allow for users to receive visible and/or audible traffic related alerts on mobile devices, where
(Continued)

the alerts are based on data shared between nearby drivers, pedestrians, and the traffic controlling equipment.

16 Claims, 9 Drawing Sheets

Related U.S. Application Data

(60) Provisional application No. 62/628,593, filed on Feb. 9, 2018.

(51) Int. Cl.
*G08G 1/095* (2006.01)
*G08G 1/09* (2006.01)

(52) U.S. Cl.
CPC ..... *G08G 1/0141* (2013.01); *G08G 1/091* (2013.01); *G08G 1/095* (2013.01)

(56) References Cited

U.S. PATENT DOCUMENTS 5,172,113 A 12/1992 Hamer
5,187,373 A 2/1993 Gregori
5,187,476 A 2/1993 Hamer
5,202,683 A 4/1993 Hamer et al.
5,278,555 A 1/1994 Hoekman
5,281,965 A 1/1994 Hoekman et al.
5,508,698 A 4/1996 Hoekman
5,523,753 A 6/1996 Fedde et al.
5,539,398 A 7/1996 Hall et al.
5,602,739 A 2/1997 Haagenstad et al.
5,621,645 A 4/1997 Brady
5,734,338 A 3/1998 Hoekman et al.
5,745,865 A 4/1998 Rostoker et al.
5,751,225 A 5/1998 Fedde et al.
5,850,192 A 12/1998 Turk et al.
5,926,113 A 7/1999 Jones et al.
5,955,968 A 9/1999 Bentrott et al.
5,986,575 A 11/1999 Jones et al.
6,133,854 A 10/2000 Yee et al.
6,243,026 B1 6/2001 Jones et al.
6,326,903 B1 12/2001 Gross et al.
6,621,420 B1 9/2003 Poursartip
6,870,489 B2 3/2005 Cybulski
6,940,422 B1 9/2005 Bachelder et al.
6,958,707 B1 10/2005 Siegel
6,989,766 B2 1/2006 Mese et al.
7,307,547 B2 12/2007 Schwartz
7,317,406 B2 1/2008 Wolterman
7,327,280 B2 2/2008 Bachelder et al.
7,333,028 B2 2/2008 Schwartz
7,417,560 B2 8/2008 Schwartz
7,432,826 B2 10/2008 Schwartz
7,515,064 B2 4/2009 Schwartz
7,573,399 B2 8/2009 Schwartz
7,642,928 B2 1/2010 Hutchison
7,647,180 B2 1/2010 Breed
7,663,505 B2 2/2010 Publicover
7,808,401 B1 10/2010 Schwartz et al.
7,868,783 B2 1/2011 Bachelder
7,952,491 B2 5/2011 Schwartz et al.
7,982,631 B2 7/2011 Schwartz et al.
8,031,062 B2 10/2011 Smith
8,072,346 B2 12/2011 Hall et al.
8,319,662 B1 11/2012 Bontemps et al.
8,325,062 B2 12/2012 Johnson
8,344,908 B2 1/2013 Johnson
8,373,578 B1 2/2013 Sikora et al.
8,487,780 B2 7/2013 Edwardson
8,610,596 B2 12/2013 Johnson
8,618,954 B2 12/2013 Free
8,700,299 B2 * 4/2014 Morita ..... G08G 1/096716 701/123
8,773,282 B2 7/2014 Cross
8,783,626 B2 7/2014 Cross
8,823,548 B2 9/2014 Johnson et al.
8,830,085 B2 9/2014 Edwardson et al.
8,878,695 B2 11/2014 Cross
8,884,783 B2 11/2014 Roberts et al.
8,912,922 B2 12/2014 Eichhorst
8,972,145 B2 3/2015 Mahler et al.
9,208,684 B2 12/2015 Beum et al.
9,299,253 B2 3/2016 Eichhorst
9,302,687 B2 4/2016 Cross
9,330,566 B2 5/2016 Cross
9,361,798 B2 6/2016 Neuman
9,460,620 B2 10/2016 Evans
9,478,131 B2 10/2016 Eichhorst
9,536,427 B2 1/2017 Tonguz et al.
9,542,852 B2 1/2017 Cross et al.
9,564,049 B2 2/2017 Diba
9,751,543 B2 9/2017 Cross
9,773,411 B2 9/2017 Popple
9,799,221 B2 10/2017 Baller
9,911,334 B2 3/2018 Townsend
9,916,759 B2 3/2018 Cross
9,922,559 B1 3/2018 Inoue
9,928,738 B2 3/2018 Bauer et al.
9,947,219 B2 4/2018 Rolle et al.
9,953,522 B2 4/2018 Cross et al.
9,965,951 B1 5/2018 Gallagher et al.
9,978,270 B2 5/2018 Raamot
9,990,548 B2 6/2018 Wellington et al.
10,019,898 B2 7/2018 Miller
10,029,716 B2 7/2018 Cross et al.
10,121,370 B2 11/2018 Elsheemy
10,127,811 B2 11/2018 Xu et al.
10,198,947 B2 2/2019 Meyer et al.
10,217,356 B2 2/2019 Baller
10,311,725 B2 6/2019 Cross et al.
10,365,115 B2 * 7/2019 Nair ..... G08G 1/0145
11,030,895 B1 6/2021 Kulus et al.
11,069,234 B1 * 7/2021 Mulligan ..... G08G 1/08
11,158,189 B2 10/2021 Edwardson et al.
11,200,802 B1 12/2021 Edwardson
11,232,707 B1 1/2022 Kulus et al.
11,237,554 B2 * 2/2022 Rezaeian ..... G06F 3/013
2002/0027510 A1 3/2002 Jones
2005/0104745 A1 * 5/2005 Bachelder ..... G08G 1/01 340/988
2005/0187701 A1 * 8/2005 Baney ..... G08G 1/096758 340/907
2009/0167561 A1 * 7/2009 Liang ..... G08G 1/095 340/907
2009/0287401 A1 * 11/2009 Levine ..... G01C 21/3438 701/117
2010/0030458 A1 * 2/2010 Coughlin ..... B60W 40/09 701/123
2010/0082190 A1 * 4/2010 Jinno ..... B60K 6/52 903/918
2010/0171640 A1 * 7/2010 Delia ..... G08G 1/07 340/907
2010/0308986 A1 * 12/2010 Dobryden ..... G08C 17/02 340/439
2011/0043348 A1 * 2/2011 Blackard ..... F16H 63/42 340/439
2011/0126797 A1 * 6/2011 Russell ..... F02D 19/0692 123/294
2014/0336913 A1 * 11/2014 Fino ..... G08G 1/096811 701/465
2015/0145995 A1 * 5/2015 Shahraray ..... B60R 1/00 348/148
2015/0154860 A1 * 6/2015 Holzwanger ..... G08G 1/0967 340/944
2016/0063859 A1 3/2016 Leung
2016/0148267 A1 5/2016 Pittman et al.
2016/0148507 A1 * 5/2016 Pittman ..... G08G 1/095 340/917
2016/0358463 A1 * 12/2016 Cho ..... G08G 1/0145
2017/0124868 A1 * 5/2017 Bhat ..... G08G 1/09623
2017/0154525 A1 * 6/2017 Zou ..... G08G 1/0145

(56) References Cited

U.S. PATENT DOCUMENTS

| | | | | |
|---|---|---|---|---|
| 2017/0301237 | A1 | 10/2017 | MacNeille et al. | |
| 2017/0372602 | A1 | 12/2017 | Gilliland et al. | |
| 2018/0047286 | A1 | 2/2018 | Gage et al. | |
| 2018/0075739 | A1* | 3/2018 | Ginsberg | G08G 1/096783 |
| 2018/0090009 | A1 | 3/2018 | Roessler et al. | |
| 2018/0096595 | A1 | 4/2018 | Janzen et al. | |
| 2018/0144203 | A1 | 5/2018 | Moosaei et al. | |
| 2018/0151064 | A1* | 5/2018 | Xu | G08G 1/0133 |
| 2018/0157258 | A1* | 6/2018 | O'Brien | G05D 1/0088 |
| 2018/0190111 | A1 | 7/2018 | Green et al. | |
| 2018/0253968 | A1* | 9/2018 | Yalla | G08G 1/097 |
| 2018/0261083 | A1* | 9/2018 | Sun | G08G 1/056 |
| 2018/0268692 | A1 | 9/2018 | Takada | |
| 2018/0286228 | A1* | 10/2018 | Xu | G08G 1/07 |
| 2019/0080186 | A1* | 3/2019 | Zhai | G06F 16/29 |
| 2019/0082377 | A1* | 3/2019 | Silver | H04W 88/16 |
| 2019/0086219 | A1* | 3/2019 | Hashisho | G05D 1/0223 |
| 2019/0122178 | A1* | 4/2019 | Kempf | G06Q 10/063114 |
| 2019/0122548 | A1* | 4/2019 | Sakuma | G08G 1/08 |
| 2019/0172346 | A1 | 6/2019 | Barker | |
| 2019/0180617 | A1* | 6/2019 | Hori | B60W 50/0097 |
| 2019/0228593 | A1* | 7/2019 | Liu | G07B 15/063 |
| 2019/0272747 | A1* | 9/2019 | Raamot | G08G 1/08 |
| 2020/0184238 | A1* | 6/2020 | Kobayashi | G06V 40/161 |
| 2020/0242922 | A1 | 7/2020 | Dulberg | |
| 2022/0003562 | A1 | 1/2022 | Mack et al. | |

FOREIGN PATENT DOCUMENTS

| | | | |
|---|---|---|---|
| DE | 102014204059 | A1 | 9/2015 |
| IN | 01758MU2013 | | 5/2014 |
| WO | 2017215365 | | 12/2017 |

OTHER PUBLICATIONS

Mlinaric, M., "Intelligent traffic control with priority for emergency vehicles", Dec. 31, 2016.

Goel, et al., "Self-Organization in Traffic Lights; Evolution of Signal Control with Advances in Sensors and Communications", Jun. 18, 2017.

Jagadeesh, et al., "Smart Autonomous Traffic Light Switching by Traffic Density Measurement through Sensors", Jan. 1, 2015.

Ossama Younis, et al., "Employing Cyber-Physical Systems: Dynamic Traffic Light Control at Road Intersections", Dec. 1, 2017.

* cited by examiner

SYSTEMS, METHODS, AND DEVICES FOR COMMUNICATION BETWEEN TRAFFIC CONTROLLER SYSTEMS AND MOBILE TRANSMITTERS AND RECEIVERS

CROSS REFERENCE TO RELATED APPLICATIONS

This application is a continuation patent application of, and claims the benefit of and priority to, U.S. Non-Provisional patent application Ser. No. 16/272,803, filed on Feb. 11, 2019, and entitled "SYSTEMS, METHODS, AND DEVICES FOR COMMUNICATION BETWEEN TRAFFIC CONTROLLER SYSTEMS AND MOBILE TRANSMITTERS AND RECEIVERS," which claims the benefit of and priority to U.S. Provisional Patent Application No. 62/628,593, filed on Feb. 9, 2018, and entitled "SYSTEMS, METHODS, AND DEVICES FOR COMMUNICATION BETWEEN TRAFFIC CONTROLLER SYSTEMS AND MOBILE TRANSMITTERS AND RECEIVERS," the disclosures of which are incorporated by reference in their entireties as if the same were fully set forth herein.

TECHNICAL FIELD

The present systems, methods, and devices relate generally to traffic management systems, and more particularly to systems, methods, and devices for modifying a present or future traffic light state, and receiving traffic related alerts.

BACKGROUND

The technology included in conventional traffic controllers and lighting systems has largely remained unchanged for the past century. Generally, controller boxes regulate the states of one or more lights at intersections, crosswalks, beacons, etc., for dictating the right-of-way for drivers and pedestrians. Despite the seemingly acceptable functionality of preexisting traffic systems, modern technology is rapidly outpacing the status quo. Technological advancements such the growth of the internet-of-things (IOT), radio frequency and cellular communications, and even machine learning have allowed for improvements in the way people engage in transportation (e.g., autonomous driving, GPS navigation, in-car audio systems, etc.). These technological capabilities were not contemplated when designing conventional traffic controlling systems. Therefore, there exists a long felt but unresolved need for systems, methods, and apparatuses that improve traffic controllers by connecting the mobile phones, automobiles, or other communication hardware available to drivers and pedestrians alike to the systems that regulate traffic for improving the safety and overall experience of citizens on the road.

BRIEF SUMMARY OF DISCLOSURE

The present systems, methods, and devices relate generally to the management of traffic controllers and traffic lights/signals based on cellular and/or radio frequency data transmitted to and received from mobile devices, automobiles, or other communication hardware available to drivers and pedestrians. In one embodiment, the system, methods, and devices discussed in the present disclosure aim to improve outdated and conventional traffic controllers by integrating hardware and software solutions that allow for traffic related data to be shared between the traffic controllers, drivers, and pedestrians to promote a safer, more efficient, and overall enhanced traffic environment.

Consider, for example, a scenario where an emergency response vehicle (or the like) is travelling on a particular route and is approaching an intersection. Conventional traffic control systems (controller boxes located at every intersection which control the state of traffic lights) are not equipped to accommodate the emergency response vehicle in the event that it encounters a red traffic light, or even a generally busy and congested intersection. In this scenario, the emergency response vehicle relies solely on the sounding sirens and lights to alert drivers about the incoming emergency response vehicle, which is not always effective. As is well known by anyone who has operated a motor vehicle, it is not always easy to determine how far away an approaching emergency response vehicle is, what direction it is approaching from, and in some instances the sirens and lights may not be noticeable until it is too late. These types of scenarios often cause confusion amongst drivers and are generally unsafe for all parties involved. Embodiments of the present systems, methods, and devices allow for traffic controllers to communicate with motor vehicles (e.g., emergency response vehicles, civilian operated motor vehicles, etc.) and pedestrians in order to manipulate traffic to allow for particular vehicles to pass through certain areas without complications.

Another example of applications for embodiments of the present disclosure include the ability for the present systems, methods, and devices to provide drivers with sensory ques (e.g., visual and audible) regarding upcoming traffic states via the drivers' mobile devices or displays integrated with the drivers' automobiles (e.g., navigation systems, dashboard touch screens, etc.). In one embodiment, a driver may be approaching a particular intersection or stop sign that is nearby but still not visible (e.g., the driver's line of sight is obstructed by a natural landmark, building, etc.). In this embodiment, the automobile's audio/visual system, or the mobile computing device of the driver, may present the driver with visual and/or audio ques about the upcoming traffic state. For example, if the driver was approaching a stop sign, the mobile device speaker or automobile sound system may audibly produce an audio que such as "Stop sign ahead," and a display may present the user with a visual indication of where the stop sign is in relation to the vehicle, how many drivers are currently waiting at the stop sign, etc. If the driver was approaching an intersection, the driver may be presented with a visual indication that the light is currently green, yellow, or red, prior to the driver's ability to see the physical light structure. This visual indication may be presented in various ways, such as replicating the traffic light layout on a mobile device screen, dashboard touchscreen, or hologram display integrated within the windshield. For example, the visual indication may resemble two arrows, a straight arrow and a left-curved arrow. In this example, the straight arrow may be green, indicating that the current state of the traffic light allows for drivers to continue through the light without stopping. Continuing with this example, the left-curved arrow may be red, indicating that the current state of the traffic light requires drivers intending to turn left to wait for the light state to switch to green. According to various embodiments, the arrows may be represented as two dimensional icons on a flat display such as an LCD or LED screen, or the arrows maybe presented as a semi-transparent hologram or projection within a glass pane.

In some embodiments, the system may track the timing of certain traffic lights, thereby allowing the system to present drivers with information such as when the light will turn from one state to another. Furthermore, the system may present these ques, alerts, and notifications audibly. In one embodiment, a driver may be stopped at a red light and not paying attention to the status of the traffic light (e.g., checking his/her emails on his/her mobile device). In this scenario, the system may present the user with an audible que, such as sounding "Get ready for green," which notifies the driver that the light will soon change from red to green. This allows for the driver to be prepared to begin moving his/her vehicle promptly, which may reduce overall traffic due to the decrease of propagated wait times that result from distracted drivers and delayed action at green lights. To do so, however, the present system should have knowledge of the impending change to "green" of the relevant traffic light.

In some embodiments, the functionality of the present systems, methods, and devices, may be implemented in or promote the development of autonomous driving vehicles. As will be described in further detail herein, the data transmitted and received between traffic controlling systems and the mobile devices of the vehicle drivers (or the vehicles themselves) may provide the traffic data for coordinating a safe environment for a hands-off driving ecosystem.

According to various aspects of the present disclosure, an exemplary environment where the present systems may operate includes components such as radio frequency (RF) transmitters and receivers, cellular data transmitters and receivers (e.g., mobile phones or standalone components), traffic hardware (e.g., stoplights, beacons, curve warning, stop sign approaching, etc.) and their corresponding HW/SW controller systems, and a wireless communications network. In one embodiment, implementations of the systems and methods include a back-and-forth communication of data between the driver/vehicle and the traffic controllers, the data including information such as GPS, intersection geometry, identification data, priority data (e.g., emergency response vehicle data), etc., and this data is used to further coordinate safer traffic ecosystems and also provide drivers with enhanced insight into traffic states and conditions.

In some embodiments, a cloud-based server may also be included in the system. In one embodiment, the cloud-based server may allow for remote computing of particular traffic-related messages, as well as facilitate communication between system components.

In various embodiments, the present disclosure discusses a method including the steps of: receiving, at a mobile computing device, MAP data corresponding to a plurality of intersections, the MAP data including intersection geometry corresponding to each of the plurality of intersections, wherein the intersection geometry includes coordinates corresponding to a physical layout of each of the plurality of intersections; receiving signal, phase, and timing (SPAT) data, the SPAT data including one or more traffic light states at the plurality of intersections; determining a GPS position and a velocity of the mobile computing device; comparing at least the GPS position and the velocity associated with the mobile computing device to the coordinates corresponding to the physical layout of each of the plurality of intersections of the MAP data to determine relevant SPAT data, wherein the relevant SPAT data corresponds to a particular intersection determined to be an approaching intersection based on the GPS position and velocity of the mobile computing device; and generating an alert corresponding to the approaching intersection, wherein the alert is presented via the mobile computing device and corresponds to the one or more traffic light states associated with the relevant SPAT data.

In one embodiment, the one or more traffic light states includes a traffic light color and a traffic light timer. In various embodiments, the one or more traffic light states includes data corresponding to current and/or future states at the plurality of intersections. In a particular embodiment, the alert includes displaying a notification on a digital screen at the mobile computing device, the notification including an indication of the physical layout of the approaching intersection, wherein the indication of the physical layout includes arrows arranged and colored according to the MAP data and the traffic light color. In certain embodiments, the alert further includes displaying a visual representation of the traffic light timer on the digital screen, and wherein the traffic light timer corresponds to a scheduled change to the one or more traffic light states.

According to various aspects of the present disclosure, and in response to the scheduled change to the one or more traffic light states, the method further includes the step of generating an updated alert for presenting the change to the one or more traffic light states. In some embodiments, the method further includes the step of generating an audible cue corresponding to the alert, wherein the audible cue is announced via a speaker at the mobile computing device. In a particular embodiment, the audible cue includes the phrase "Get ready for green!"

In various embodiments, the present disclosure discusses a system for generating traffic-related alerts, the system including: a plurality of computing devices, each of the plurality of computing devices including a processor running a software application and operable to present software application views on a digital display at each the plurality of computing devices, wherein each of the plurality of computing devices further includes a cellular communication module and computer memory for cataloging MAP data corresponding to intersection geometry associated with a plurality of traffic intersections, the intersection geometry including coordinates corresponding to a physical layout of each of the plurality of traffic intersections; and a plurality of processing units at a plurality of traffic intersection controllers corresponding to the plurality of traffic intersections, wherein each of the plurality of processing units include a cellular modem, and the processing units are operable to: transmit, via the cellular modem, MAP data to the plurality of computing devices for cataloging the MAP data at the plurality of computing devices; and in response to determining an event including a change to one or more traffic light states at the plurality of traffic intersections, transmit signal, phase, and timing ("SPAT") data corresponding to the one or more traffic light states, wherein each of the plurality of computing devices compares the coordinates corresponding to the physical layout of each of the plurality of traffic intersections of the MAP data to a determined velocity and GPS location of the mobile computing device to determine relevant SPAT data corresponding to a particular intersection determined to be an approaching intersection based on the GPS location and velocity, and generates an approaching traffic scenario to be presented on the digital display as a software application view, wherein the approaching traffic scenario includes visual representations of the one or more traffic light states.

In one embodiment, the one or more traffic light states includes a traffic light color and a traffic light timer. In various embodiments, the one or more traffic light states include data corresponding to the current and/or future states at the plurality of traffic intersections. In particular embodiments, the approaching traffic scenario includes a visual representation of the physical layout of the approaching intersection, wherein the visual representation of the physical layout includes arrows arranged and colored according to the MAP data and traffic light color. In certain embodiments, the approaching traffic scenario further includes displaying a visual representation of the traffic light timer on the digital screen, and wherein the traffic light timer corresponds to a scheduled change to the one or more traffic light states.

According to various aspects of the present disclosure, in response to the scheduled change to the one or more traffic light states, the processing units are further operable to generate an updated approaching traffic scenario for visually representing the change to the one or more traffic light states. In certain embodiments, the approaching traffic scenario includes an audible cue announced via a speaker at the mobile computing device. In one embodiment, the audible cue includes the phrase "Get ready for green!" In a particular embodiment, the plurality of computing devices are smart phones and/or on-board automobile computing systems.

These and other aspects, features, and benefits of the claimed embodiment(s) will become apparent from the following detailed written description of the preferred embodiments and aspects taken in conjunction with the following drawings, although variations and modifications thereto may be effected without departing from the spirit and scope of the novel concepts of the disclosure.

DEFINITIONS

Prior to a detailed description of the disclosure, the following definitions are provided as an aid to understanding the subject matter and terminology of aspects of the present systems and methods, are exemplary, and not necessarily limiting of the aspects of the systems and methods, which are expressed in the claims. Whether or not a term is capitalized is not considered definitive or limiting of the meaning of a term. As used in this document, a capitalized term shall have the same meaning as an uncapitalized term, unless the context of the usage specifically indicates that a more restrictive meaning for the capitalized term is intended. However, the capitalization or lack thereof within the remainder of this document is not intended to be necessarily limiting unless the context clearly indicates that such limitation is intended.

1. Basic Safety Message (BSM): In one embodiment, a basic safety message comprises data relating to a past and current status of a particular vehicle (or pedestrian). For example, a BSM may include data such as vehicle position, speed, heading, acceleration, vehicle size, vehicle mass, steering wheel angle, recent braking data, a time stamp, etc. In the system discussed herein, BSMs may be periodically transmitted from communication devices at vehicles or pedestrians, and the transmissions may be cellular, RF, Wi-Fi, and/or Bluetooth transmissions to a cellular network, an RF receiver, or an on-board unit at another vehicle or pedestrian.

2. Personal Safety Message (PSM): In one embodiment, a personal safety message generally relates to past and current traffic-related activity of an individual (e.g., a pedestrian) within the system. For example, a PSM may include data such as position, speed, heading, acceleration, and a time stamp corresponding to the individual's travel-related activity within the system, and this data may be transmitted periodically via the individual's mobile phone. In some embodiments, PSMs may be "reduced" BSMs, where information specific to automobiles (that is typically included in a BSM) is not included in a transmitted PSM. In various embodiments, PSMs allow for pedestrian activity to be considered along with vehicle activity when analyzing traffic scenarios in a smart-city environment.

3. Signal, Phase, and Timing (SPAT or SPaT): SPAT data generally includes a present (or future) status of a traffic light controller unit at an intersection in a roadway. For example, SPAT data includes at least a current light state or phase (e.g., green, red, yellow, etc.) for each light controlled by the traffic light controller (and each lane if appropriate), and furthermore a timer associated with each light state. In various embodiments, the timer may be a countdown timer indicating when the light state will change, or the timer may be a running timer indicating how long the light state has been active.

4. MAP Data: In various embodiments, a MAP message, or MAP data, generally includes a representation of a particular intersection geometry. For example, MAP data may include data relating to how many roads converge on an intersection, the number of lanes per road, lane types (e.g., thru-lane, turning lane, etc.), and geographic data (e.g., longitude/latitude coordinates, reference distances, etc.) outlining this information (and more) for providing a "blueprint" of the intersection geometry.

BRIEF DESCRIPTION OF DRAWINGS

The accompanying drawings illustrate one or more embodiments and/or aspects of the disclosure and, together with the written description, serve to explain the principles of the disclosure. Wherever possible, the same reference numbers are used throughout the drawings to refer to the same or like elements of an embodiment, and wherein.

DETAILED DESCRIPTION

Figure 1:
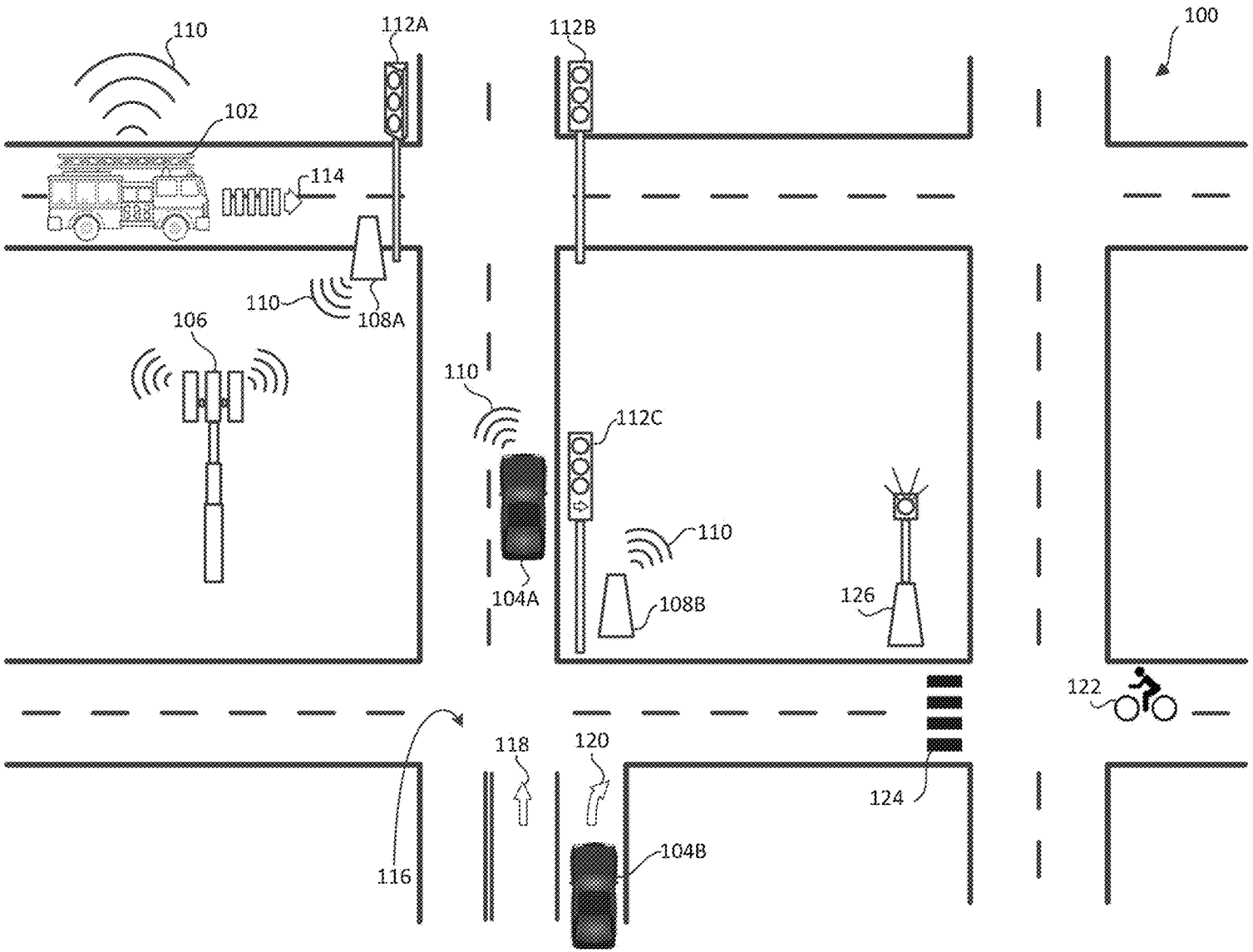
FIG. 1 illustrates an exemplary operational environment of the present system, according to one aspect of the present disclosure.

For the purpose of promoting an understanding of the principles of the present disclosure, reference will now be made to the embodiments illustrated in the drawings and specific language will be used to describe the same. It will, nevertheless, be understood that no limitation of the scope of the disclosure is thereby intended; any alterations and further modifications of the described or illustrated embodiments, and any further applications of the principles of the disclosure as illustrated therein are contemplated as would normally occur to one skilled in the art to which the disclosure relates. All limitations of scope should be determined in accordance with and as expressed in the claims.

Briefly described, and according to one embodiment, aspects of the present disclosure relate generally to the management of traffic controllers and traffic lights/signal based on cellular and/or radio frequency data transmitted to and received from mobile devices, automobiles, or other communication hardware available to drivers and pedestrians. In one embodiment, the system, methods, and devices discussed in the present disclosure aim to improve outdated and conventional traffic controllers by integrating hardware and software solutions that allow for traffic related data to be shared between the traffic controllers, drivers, and pedestrians to promote a safer, more efficient, and overall enhanced traffic environment.

Consider, for example, a scenario where an emergency response vehicle (or the like) is travelling on a particular route and is approaching an intersection. Conventional traffic control systems (controller boxes located at every intersection which control the state of traffic lights) are not equipped to accommodate the emergency response vehicle in the event that it encounters a red traffic light, or even a generally busy and congested intersection. In this scenario, the emergency response vehicle relies solely on the sounding sirens and lights to alert drivers about the incoming emergency response vehicle, which is not always effective. As is well known by anyone who has operated a motor vehicle, it is not always easy to determine how far away an approaching emergency response vehicle is, what direction it is approaching from, and in some instances the sirens and lights may not be noticeable until it is too late. These types of scenarios often cause confusion amongst drivers and are generally unsafe for all parties involved. Embodiments of the present systems, methods, and devices allow for traffic controllers to communicate with motor vehicles (e.g., emergency response vehicles, civilian operated motor vehicles, etc.) and pedestrians in order to manipulate traffic to allow for particular vehicles to pass through certain areas without complications.

Another example of applications for embodiments of the present disclosure include the ability for the present systems, methods, and devices to provide drivers with sensory ques (e.g., visual and audible) regarding upcoming traffic states via the drivers' mobile devices or displays integrated with the drivers' automobiles (e.g., navigation systems, dashboard touch screens, etc.). In one embodiment, a driver may be approaching a particular intersection or stop sign that is nearby but still not visible (e.g., the driver's line of sight is obstructed by a natural landmark, building, etc.). In this embodiment, the automobile's audio/visual system, or the mobile computing device of the driver, may present the driver with visual and/or audio ques about the upcoming traffic state. For example, if the driver was approaching a stop sign, the mobile device speaker or automobile sound system may audibly produce an audio que such as "Stop sign ahead," and a display may present the user with a visual indication of where the stop sign is in relation to the vehicle, how many drivers are currently waiting at the stop sign, etc. If the driver was approaching an intersection, the driver may be presented with a visual indication that the light is currently green, yellow, or red, prior to the driver's ability to see the physical light structure. This visual indication may be presented in various ways, such as replicating the traffic light layout on a mobile device screen, dashboard touchscreen, or hologram display integrated within the windshield. For example, the visual indication may resemble two arrows, a straight arrow and a left-curved arrow. In this example, the straight arrow may be green, indicating that the current state of the traffic light allows for drivers to continue through the light without stopping. Continuing with this example, the left-curved arrow may be red, indicating that the current state of the traffic light requires drivers intending to turn left to wait for the light state to switch to green. According to various embodiments, the arrows may be represented as two dimensional icons on a flat display such as an LCD or LED screen, or the arrows maybe presented as a semi-transparent hologram or projection within a glass pane.

In some embodiments, the system may track the timing of certain traffic lights, thereby allowing the system to present drivers with information such as when the light will turn from one state to another. Furthermore, the system may present these ques, alerts, and notifications audibly. In one embodiment, a driver may be stopped at a red light and not paying attention to the status of the traffic light (e.g., checking his/her emails on his/her mobile device). In this scenario, the system may present the user with an audible que, such as sounding "Get ready for green," which notifies the driver that the light will soon change from red to green. This allows for the driver to be prepared to begin moving his/her vehicle promptly, which may reduce overall traffic due to the decrease of propagated wait times that result from distracted drivers and delayed action at green lights. To do so, however, the present system should have knowledge of the impending change to "green" of the relevant traffic light.

In some embodiments, the functionality of the present systems, methods, and devices, may be implemented in or promote the development of autonomous driving vehicles. As will be described in further detail herein, the data transmitted and received between traffic controlling systems and the mobile devices of the vehicle drivers (or the vehicles themselves) may provide the traffic data for coordinating a safe environment for a hands-off driving ecosystem.

According to various aspects of the present disclosure, an exemplary environment where the present systems may operate includes components such as radio frequency (RF) transmitters and receivers, cellular data transmitters and receivers (e.g., mobile phones or standalone components), traffic hardware (e.g., stoplights, beacons, curve warning, stop sign approaching, etc.) and their corresponding HW/SW controller systems, and a wireless communications network. In one embodiment, implementations of the systems and methods include a back-and-forth communication of data between the driver/vehicle and the traffic controllers, the data including information such as GPS, intersection geometry, identification data, priority data (e.g., emergency response vehicle), etc., and this data is used to further coordinate safer traffic ecosystems and also provide drivers with enhanced insight into traffic states and conditions.

In some embodiments, a cloud-based server may also be included in the system. In one embodiment, the cloud-based server may allow for remote computing of particular traffic-related messages, as well as facilitate communication between system components.

In various embodiments, novel aspects of the disclosed systems, methods, and devices may include (but are not limited to) a combination of cellular and RF signals transmitted from an automobile or user's mobile computing device to a traffic control system for managing current or future traffic states; RF and/or cellular data communication from the traffic control system to a mobile computing device or receiver including data such as current status and future status of the particular intersection controlled by the traffic control system, which may be used to provide users with alerts such as "Get ready for green" on their mobile computing devices; and allowing other traffic light devices, such as school beacons, to transmit the status of those devices to drivers for alerting the drivers about approaching school zones, occupied cross walks, etc.

Referring now to the drawings, FIG. 1 illustrates an exemplary operational environment 100 of the present system, according to one aspect of the present disclosure. As depicted in the present embodiment, the operational environment 100 is a roadway including various motor vehicles, cyclists, and in some embodiments even pedestrians, etc. According to various aspects of the present disclosure, the operational environment 100 includes various networked components including (but not limited to) mobile phones, various signal transmitters and receivers, cellular modems, sensors including GPS, velocity, Wi-Fi, and Bluetooth sensors, and processors for analyzing data, readings, and requests from each of these various networked components. In one embodiment, the illustrated network of hardware, computing devices, and components allows for various improvements in traffic management such as allowing for a user to change traffic light states on-demand (or in the future), and allowing for individuals to receive traffic alerts unique to their position and direction of travel, where the alerts provide the individuals with information for allowing them to make better traffic-related decisions.

As depicted in the present embodiment, the operational environment 100 includes motor vehicles such as a fire truck 102 and cars 104A and 104B. According to various aspects of the present disclosure, at least one network component for allowing devices in the system to communicate is a cellular network 106, or cellular network backbone. In a particular embodiment, the cellular network 106 includes the infrastructure (e.g., cell towers, receivers, transmitters, repeaters, modems, etc., for supporting broadband, 3G, 4G, 5G, LTE, etc.) for allowing computing devices, processors, and sensors to send information across a cellular medium. In one embodiment, the cellular network 106 is operable to transmit and receive cellular data between the motor vehicles including the fire truck 102 and the cars 104A-B, as well as between a plurality of traffic intersection controller units 108 (e.g., intersection hardware cabinets). As shown in the present embodiment, the fire truck 102, each of the cars 104A-B, and each of the plurality of traffic intersection controller units 108 includes emanating signal waves 110 indicating active communication between these components and the cellular network 106.

Continuing with FIG. 1, the plurality of traffic intersection controller units 108 are generally enclosed structures or cabinets including various hardware components for controlling the states of a plurality of traffic lights, which are indicated throughout the operational environment 100 as 112A, 112B, and 112C. According to various aspects of the present disclosure, the traffic intersection controller units 108 are typically close in physical proximity to the traffic lights 112, and as will be described in greater detail herein, the traffic intersection controller units 108 may initiate modifications to the current or future states of traffic lights in response to receiving particular signals from the automobiles in the operational environment 100, and the traffic intersection controller units 108 may furthermore transmit information relating to the states of the traffic lights 112 to be received at the vehicles 102, 104A, and 104B (for example).

In a particular embodiment, the operational environment 100 supports a scenario (as depicted in the present embodiment) where an emergency response vehicle, such as the fire truck 102, is approaching various traffic lights (112A and 112B). Typically, emergency response vehicles do not stop at traffic intersections but instead will approach a traffic intersection with engaged visible and audible sirens, slowly move through the traffic intersection creating chaos while cars abruptly stop and maneuver out of the direction of the emergency response vehicle, and then speed away when successfully through the traffic intersection. The present disclosure presents a solution to this problem via a dual-transmission process, where an emergency response vehicle such as the fire truck 102 simultaneously transmits a cellular signal (e.g., the signal 110 at the fire truck 102) and a radio frequency ("RF") signal 114 directed to the traffic intersection controller unit 108A, where the cellular signal 110 and the RF signal 114 are both encoded with a request to change the traffic light state. According to various aspects of the present disclosure, the system may be configured to operate such that in response to receiving a first signal of the simultaneously transmitted RF and cellular signals, the traffic intersection controller unit 108 may initiate an immediate (or future) change to the current states of the traffic lights 112A and 112B. As such, implementing embodiments of the current system allows for an emergency response vehicle to request a green light upon arrival at the traffic intersection, while intersecting and/or opposing traffic may be held at a red light state, thus preventing the dangerous and confusing scenarios discussed above.

In particular embodiments, the dual-transmission process provides a robust system that allows for efficient and reliable communication between the fire truck 102 and the traffic intersection controller unit 108. For example, in a scenario where the fire truck 102 is travelling on a straight road and is approaching a traffic intersection, both the RF signal and the cellular signal of the dual-transmission should be received at the traffic intersection controller unit 108 at about the same time (although the RF signal should be received just before the cellular signal due to latency introduced by the cellular network), thus allowing for the fire truck 102 to request a green light upon arrival. In a separate scenario where the fire truck 102 is traveling on a winding road, or traveling through an area with mountainous terrain or tall buildings, the RF signal included in the dual-transmission may not be received by the traffic intersection controller unit 108 due to interference or deflection of the RF signal (e.g., from deflecting off a building or the like). However, barring a network failure, the cellular signal is received via a reliable LTE signal (or the like), thus allowing for the fire truck 102 to communicate the request for a traffic light state change.

Still referring to FIG. 1, the system may provide users (e.g., automobile drivers, pedestrians, cyclists, etc.) with traffic-related alerts at their mobile devices or on-board navigation units, the alerts including traffic information specific to their locations, directions of travel, etc. For example, consider the intersection 116 depicted in the present embodiment. In one embodiment, the intersection 116 includes at least a thru-lane 118 and a turning lane 120, and the traffic intersection controller unit 108C and traffic light 112C control the traffic flow (of car 104B) through the intersection 116. According to various aspects of the present disclosure, a user operating the car 104B may possess a mobile computing device (such as a smart phone), or the car 104B may include an on-board communication device, such that the user may be presented with traffic related information via a digital display. In certain embodiments, and assuming the user possesses a smart phone, as the user operating the car 104B approaches the intersection 116, the user's smart phone may display an alert including a pattern of the available lanes (e.g., the thru-lane and the turning lane), the available lanes may be color-coded representative of their current state (e.g., green, red, yellow, etc.), and the alert may include timers or time indications for when the current traffic light states will change. In various embodiments, the system generates this alert (and other similar alerts) via comparing data including, but not limited to, a basic safety message (BSM) the GPS location and velocity of the car 104C, MAP (intersection geometry) data corresponding to the intersection 116, and the signal, phase, and timing (SPAT) data corresponding to the traffic intersection controller unit 108C and traffic lights 112C. In certain embodiments, these alerts may be accompanied by vocal/audible announcements of the alerts, for example, announcing "Get ready for green!" in response to the SPAT data indicating near expiration of a state timer.

According to various aspects of the present disclosure, the present system not only improves driver safety, but also improves the safety of pedestrians, bikers, etc. For example, and continuing with FIG. 1, the exemplary environment 100 further includes a cyclist 122, a crosswalk 124, and a beacon 126. As will be discussed in further detail below in association with FIG. 2, pedestrian users may connect to the networked components via their smart phones to receive traffic related alerts and data. For example, the cyclist 122 may receive an alert notifying the cyclist 122 about the car 104B and its intent to turn right, thus allowing the cyclist to prepare for and anticipate the car's behavior. Furthermore, the driver of the car 104B may receive a similar alert notifying him/her of the presence of the cyclist 122. In a particular embodiment, a pedestrian may enter the crosswalk 124, and the beacon 126 may begin to flash a light, make a noise, etc., thus signaling that the crosswalk 124 is occupied. In some embodiments, the beacon 126 is equipped with similar equipment as the traffic intersection controller units 108, and thus a pedestrian entering the crosswalk 124 may be a trigger event for initiating transmission of data such as SPAT and/or MAP data to nearby or approaching vehicles.

In certain embodiments, the SPAT and/or MAP data transmitted by the beacon 126 may be received at the car 104B, and in response the driver of the car 104B may be presented (via his/her smart phone), an alert that the cross walk 124 is occupied, an alert to slow down or stop at a certain distance from the crosswalk, etc.

Figure 2:
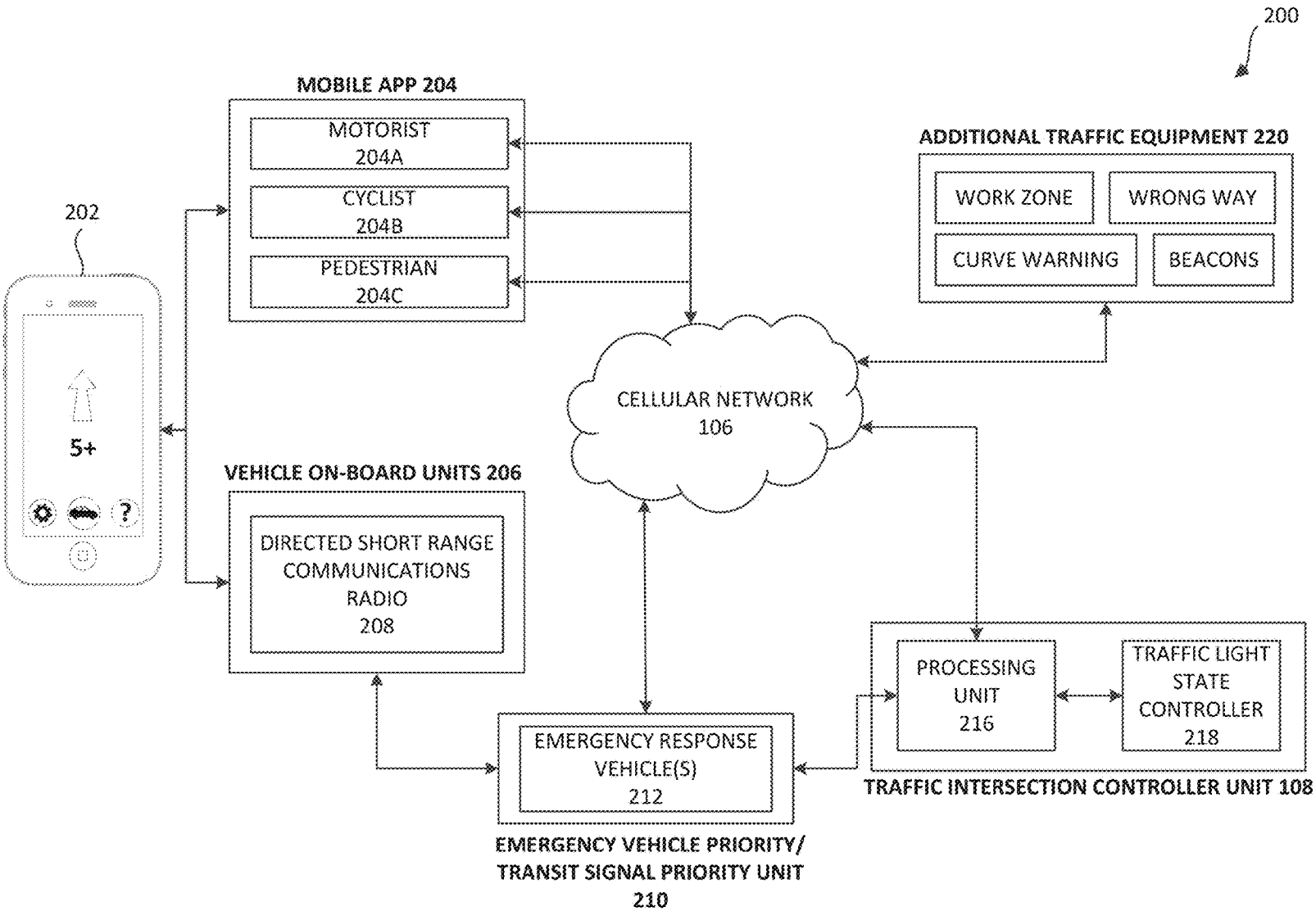
FIG. 2 illustrates an exemplary system architecture, according to one aspect of the present disclosure.

Turning now to FIG. 2, an exemplary system architecture 200 is depicted, according to one aspect of the present disclosure. In various embodiments, the exemplary system architecture 200 depicted in FIG. 2 illustrates the components of the system and how the components are connected and/or networked. As shown in the present embodiment, the exemplary system architecture 200 includes at least one or more mobile computing devices 202, where the mobile computing devices 202 allow for instances of a mobile application 204 (e.g., instances at mobile devices belonging to motorists 204A, cyclists 204B, pedestrians 204, etc.) to communicate with other devices and components in the network, and the mobile computing devices 202 also enable short range communication via vehicle on-board units ("OBUs") 206. According to various aspects of the present disclosure, OBUs 206 include directed short range communication ("DSRC") units 208, which may be operatively connected to vehicle driver's smartphone via Bluetooth, Wi-Fi, or the like, and the DSRC units 208 may communicate with nearby vehicles or pedestrians (via cellular, Bluetooth, Wi-Fi, etc.). The exemplary system architecture 200 furthermore includes emergency vehicle preemption and transit signal priority units 210 ("EVP/TSP"), where EVP/TSP units 210 may be included at emergency response vehicles 212, such as the fire truck 102, police vehicles, etc.

According to various aspects of the present disclosure, various types of data are transmitted and received between the components of the disclosed system, those data types including Basic Safety Messages (BSM), Personal Safety Messages (PSM), Signal Phase and Timing Messages (SPAT), Intersection Geometry Messages (MAP), and others. BSM and PSM type messages are standard message types including data such as vehicle speed, heading, acceleration, vehicle size, position data, etc. In various embodiments, these messages may be generated by the user's mobile computing device and may be transmitted to various traffic controllers (or mobile computing devices associated with other users) via cellular or RF signals, thereby allowing for the controlling systems at the traffic hardware to be aware of the vehicle status in near real-time. In one embodiment, the SPAT and MAP data includes information regarding the status of traffic lights as well as the layout of the intersections they control. For example, MAP data includes information outlining the layout of intersections, such as where the stop lights are positioned, how many lanes pass through the intersection, where particular lines are located on the road pavement, where turning lanes are located, etc. In various embodiments, SPAT data includes information relating to the status of each particular light. For example, receiving a SPAT message allows for the receiver to determine the current status of a particular light (e.g., green, red, yellow, etc.) and the amount of time left until the light changes state. In certain embodiments, the SPAT data and MAP data may allow for a receiver of the data to determine not only the status of an upcoming traffic obstacle, but also how to best respond to and navigate the traffic obstacle.

According to various aspects of the present disclosure, each motorist 204A, cyclist 204B, pedestrian 204C, OBU 206, and EVP/TSP unit 210 may periodically transmit or emanate their respective BSM/PSMs via a cellular device, RF transmitter, Wi-Fi, Bluetooth, etc., to the other network components, and in response receive BSM/PSM data, SPAT data, MAP data etc.

In one embodiment, each of the mobile application instances 204, vehicle OBUs 206, and EVP/TSP units 210, may communicate over a cellular network 106 (or via direct RF transmissions) with one or more traffic intersection controller units 108. According to various aspects of the present disclosure, each of the one or more traffic intersection controller units 108 may include at least a processing unit 216 and an intersection/traffic light state controller 218. In various embodiments, the at least one processing unit 216 may be a roadside processing unit including integrated cellular, GPS, and RF (e.g., 900 MHz) components, and the at least one processing unit 216 may be powered via remotely switching between NEMA 5-15 power outlets inside the traffic intersection controller unit (although the unit 216 may also include one or more battery back-ups).

In a particular embodiment, the traffic light state controller 218 may include hardware and/or software for controlling the present and future state of the traffic lights 112 (discussed in association with FIG. 1). For example, the traffic lights 112 may operate according to a state machine, or the like, where the state machine jumps between various states (e.g., green, red, and yellow lights) in response to various triggers or events. In various embodiments, an example trigger or event may include an expired timer, such as a timer for monitoring how long a particular traffic light has been green. In response to the timer expiring (or reaching a certain time from expiry) the state machine may switch from a green light state to a yellow light state. This timer may continue for switching from the yellow light state to the red light state, or a new timer may be initiated. In certain embodiments, this traffic state data may be packaged and transmitted throughout the system as signal, phase, and timing data.

In particular embodiments, the cellular network may include one or more cloud-based/remote servers for processing data received from the mobile applications 204, the OBUs 206, and the EVP/TSP units 210. According to various aspects of the present disclosure, processing the data at the cloud-based/remote servers reduces the workload at the mobile computing devices, and thus reduces the amount of time required to generate a traffic alert.

Continuing with FIG. 2, the exemplary system architecture 200 includes additional traffic equipment 220 such as, but not limited to, beacons (e.g., the beacon 126), stop signs, curve warnings, work zones, wrong way signs, etc. According to various aspects of the present disclosure, each unit of additional traffic equipment may include a cellular modem, RF sensor, or similar device for transmitting and receiving traffic related data throughout the system. For example, in response to receiving a BSM transmitted from a motorist to a nearby crosswalk beacon (for example), a processing unit at the crosswalk beacon may respond to the BSM by returning a transmission of MAP and SPAT data, where the motorist's mobile device or OBU may process the received MAP and SPAT data for presenting alerts notifying the motorist that a pedestrian currently occupies the crosswalk, that the motorist is currently exceeding the speed limit near the crosswalk, that there is a stop sign before the crosswalk, etc.

According to various aspects of the present disclosure, and in response to the mobile application 204 receiving SPAT and MAP data from nearby traffic intersection controller units 108 or beacons 126, the mobile application 204 may use this data to present to the user a visual indication of the present state of the traffic lights (e.g., displaying shaped and/or colored arrows on the mobile device 202).

According to various aspects of the present disclosure, the system architecture 200 includes exemplary components for both priority and preemption capabilities for emergency response vehicles 212, as well as general traffic alerts for regular civilian drivers and pedestrians (e.g., 204A-204C). In one embodiment, the priority and preemption specific components include the EVP/TSP 210 and/or mobile application instances 204 with dedicated short range radio communication (DSRC) capabilities. According to one embodiment, the system allows for on board units (OBUs) associated with the vehicles (e.g., emergency response vehicles 212) to transmit RF signals to receivers integrated with the processing unit 216 at the traffic controller units 108 for communicating BSMs as well as priority and preemption indicators. In certain embodiments, priority and preemption indicators may be transmitted by devices other than the OBUs, such as a driver's mobile phone. According to various aspects of the present disclosure, the priority and preemption indicators are included in BSMs or PSMs as data or data packets, such as data in a data field included in a message header, which can be read and interpreted by a receiver (e.g., a traffic controller system). For example, the BSMs transmitted from the fire truck 102 of FIG. 1 may indicate within the BSMs that the fire truck 102 is a type of emergency response vehicle, which may trigger the traffic intersection controller unit 108 to provide the fire truck 102 with a green light when approaching the intersection (e.g., via the traffic light 112A). In another example, the BSMs transmitted from a delivery vehicle or standard passenger vehicle may indicate the vehicle type, which may allow for the vehicle to receive certain priority benefits at traffic intersections such as receiving green lights during low traffic hours (e.g., early in the morning or late at night) or receiving green lights when no opposing traffic is nearby.

In particular embodiments, the OBUs 206 are proprietary communication and field I/O controllers operable to transmit cellular, RF, Wi-Fi, GPS, and other signals to systems such as the traffic intersection controller unit 108, and also the other OBUs 206 at nearby vehicles, for example. These signals are received by DSRC radios 208 at nearby vehicles, or perceived and processed by the processing unit 216 at the traffic intersection controller unit 108. In one embodiment, the processing unit 216 is a proprietary hardware add-on which may be installed to operate in parallel with the traffic light state controller 218 at the traffic intersection controller unit 108. In various embodiments, the processing unit 216 (which may be a server shelf, or the like) is configured to integrate with the preexisting traffic controller systems and further allow for the system components described herein to communicate with the processing unit 216 at particular traffic intersection controller units 108, and furthermore make informed decisions based on the communicated data.

In some embodiments, and during the dual-transmission process, the processing unit 216 at the traffic intersection controller unit 108 may be configured to process either the RF signal or the cellular signal based on signal preference or the order of which each signal is received. In other embodiments, the processing unit 216 may be configured to process both signals for purposes such as security, which ensures a single signal type is not being transmitted by a malicious or untrusted party.

In certain embodiments, the SPAT message allows for the mobile applications 204 operating in conjunction with the mobile computing devices 202 to present an alert to the user that a traffic light will change state in a particular amount of time. For example, the mobile application may be displaying a straight and green-colored arrow indicating that the current status of the light allows for the driver to continue driving through the intersection, however, if the light is scheduled to change from green to yellow in a predetermined amount of time (e.g., 5 seconds), the predetermined amount of time may be displayed in conjunction with the green arrow (e.g., below or adjacent to the arrow). In other embodiments, the timing data included in the SPAT message may allow for the driver's mobile device or built-in automobile sound system to produce an audible alert, such as "Get ready for green," which alerts the driver that a red light will change to green in a predetermined amount of time that is generally short in length (e.g., a few seconds).

Figure 3:
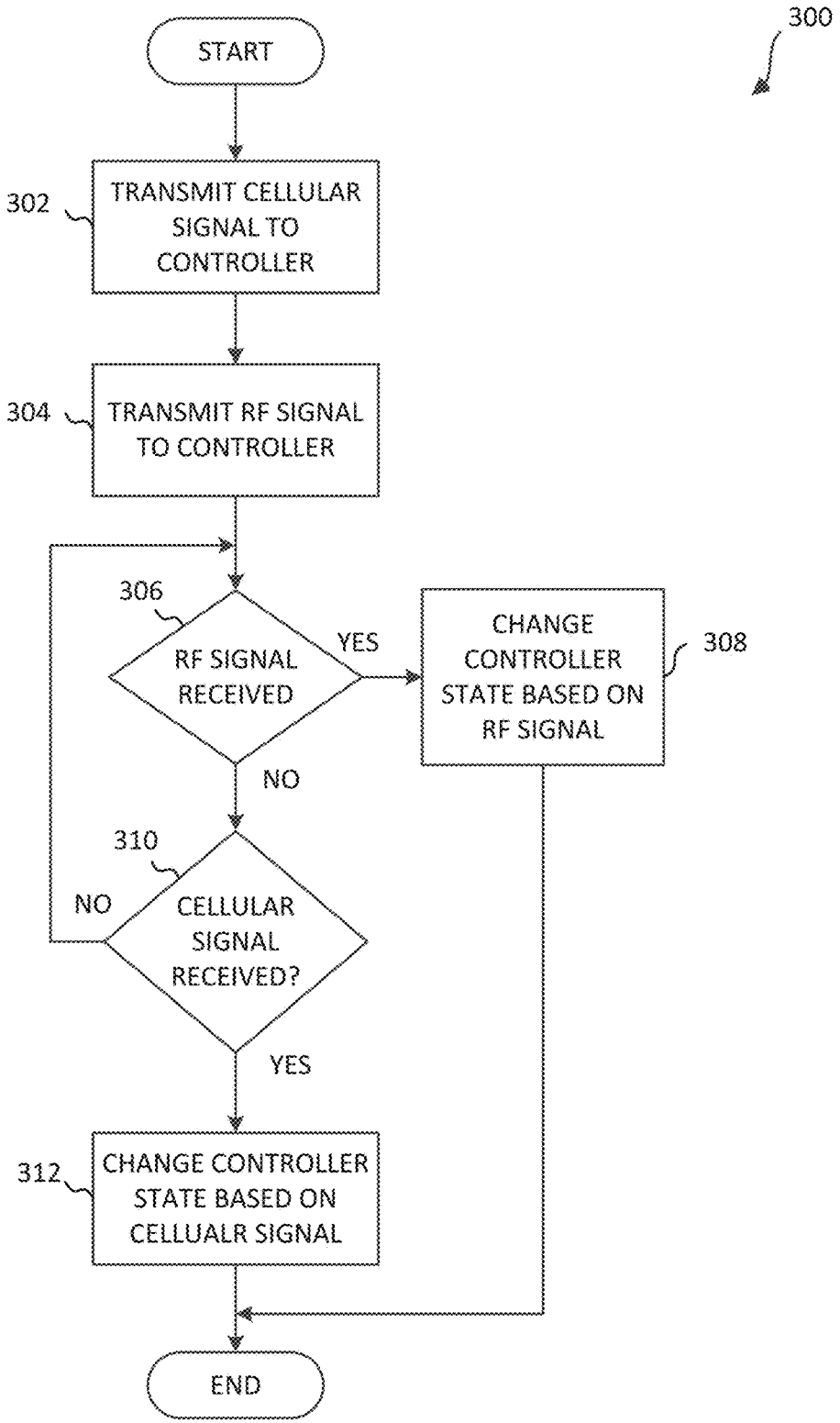
FIG. 3 is a flowchart illustrating an exemplary dual-transmission process, according to one aspect of the present disclosure.

In a particular embodiment, FIG. 3 is a flowchart illustrating an exemplary dual-transmission process 300, according to one aspect of the present disclosure. In one embodiment, this process allows for the traffic intersection controller unit 108 to receive at least the location and speed of an automobile or pedestrian (based on a BSM or PSM, respectively), and to further change the state of the controller unit 108 based on the received data. In various embodiments, the state of the controller unit 108 may be changed for various reasons. For example, the state of the controller may be changed in situations such as when an emergency response vehicle is approaching an intersection and a green light is required to ensure that the emergency vehicle passes through the intersection with minimal delay. Another example where the state of the controller may be changed is to provide certain vehicles, such as postage or package delivery vehicles, with green lights when there is no opposing traffic. Changing the state of a traffic controller to accommodate delivery vehicles allows for the vehicles to complete routes in shorter amounts of time, use less fuel, and/or deliver more packages. In another example, if the traffic controller detects a substantial amount of traffic moving from North to South through an intersection, the controller may dynamically change the East to West traffic light state or schedule to reduce the frequency of light changes, thereby preventing unnecessary stops in the North to South traffic. According to one aspect of the present disclosure, the process begins at step 302, where the mobile computing device corresponding to the automobile or pedestrian transmits a cellular signal to the traffic controller. In various embodiments, this transmission is accomplished via a cellular tower and the supporting cellular backbone infrastructure (e.g., the cellular network 106. In a particular embodiment, the cellular signal includes the BSM and/or PSM data relating to the particular automobile or pedestrian, and provides the traffic controller (e.g., the traffic intersection controller unit 108) with information such as position, speed, etc.

At step 304, the mobile computing device transmits an RF signal to the traffic controller. In some embodiments, the RF signal may be transmitted before, after, or simultaneously to the cellular signal, and the RF signal may include the same BSM or PSM data relating to the automobile or pedestrian. According to various aspects of the present disclosure, transmitting an RF signal in addition to the cellular signal provides assurance that the signal will be retrieved by the controller. For example, in one scenario, the cellular network may be inoperable. In that scenario, the RF signal may still be received by the traffic controller. In other embodiments, the RF signal may encounter interference or the signal may be deflected. In those embodiments, the cellular signal may still be received. Transmitting both cellular and RF signals to the traffic controllers enhances the reliability and robustness of the system and allows for the system to operate with an overall improved efficiency.

Continuing with FIG. 3, the process continues to step 406 where the traffic controller determines if the RF signal has been received. Referring back to steps 302 and 304 the cellular signal and RF signal are both transmitted to the traffic controller either simultaneously or in sequence. According to one aspect of the present disclosure, at step 306, the traffic controller is operable to receive at least one of the transmitted signals. If, at step 306, the RF signal is received, than the process proceeds to step 408 where the traffic controller changes the controller state based on the RF signal data. For example, if the received RF signal was transmitted from an emergency response vehicle and the signal (e.g., BSM) included a high priority indication, the traffic controller may alter the current state of the traffic lights to either stop traffic or control the flow of traffic to allow for the emergency response vehicle to pass through the intersection without complications.

If at step 306 the RF signal was not received, the process continues to step 310 where the traffic controller determines if the cellular signal was received. If the cellular signal was received at step 310, the process may proceed to step 312 where the traffic controller changes the controller state based on the received cellular data. Similarly to step 408, the data received by the traffic controller may include a BSM from an emergency response vehicle. In various embodiments, the data included in the BSM may require a state change of the traffic controller for allowing the emergency response vehicle to freely pass through the traffic intersection.

In summary, the process 300 includes transmitting to a traffic controller both a cellular and RF signal including substantially the same information regarding an automobile or pedestrian, and then changing the state of the traffic controller based on the first received message (if appropriate). In some embodiments, the process 300 may include additional steps, such as before the steps 308 and 312, where the traffic controller may process at least a portion of the received signal(s) for determining that the validity of the signal(s), the priority of the signal(s), or other aspects of the signal(s). According to various aspects of the present disclosure, both the RF and cellular signals are assembled data packets including an identification number (or the like) associated with the transmitting vehicle or corresponding device, the status of the vehicle indicators, emergency lights, door status, etc. In some embodiments, a cyclic redundancy check may be implemented to ensure data integrity of the received signals and the data included in the signals may be encrypted prior to transmission.

Figure 4:
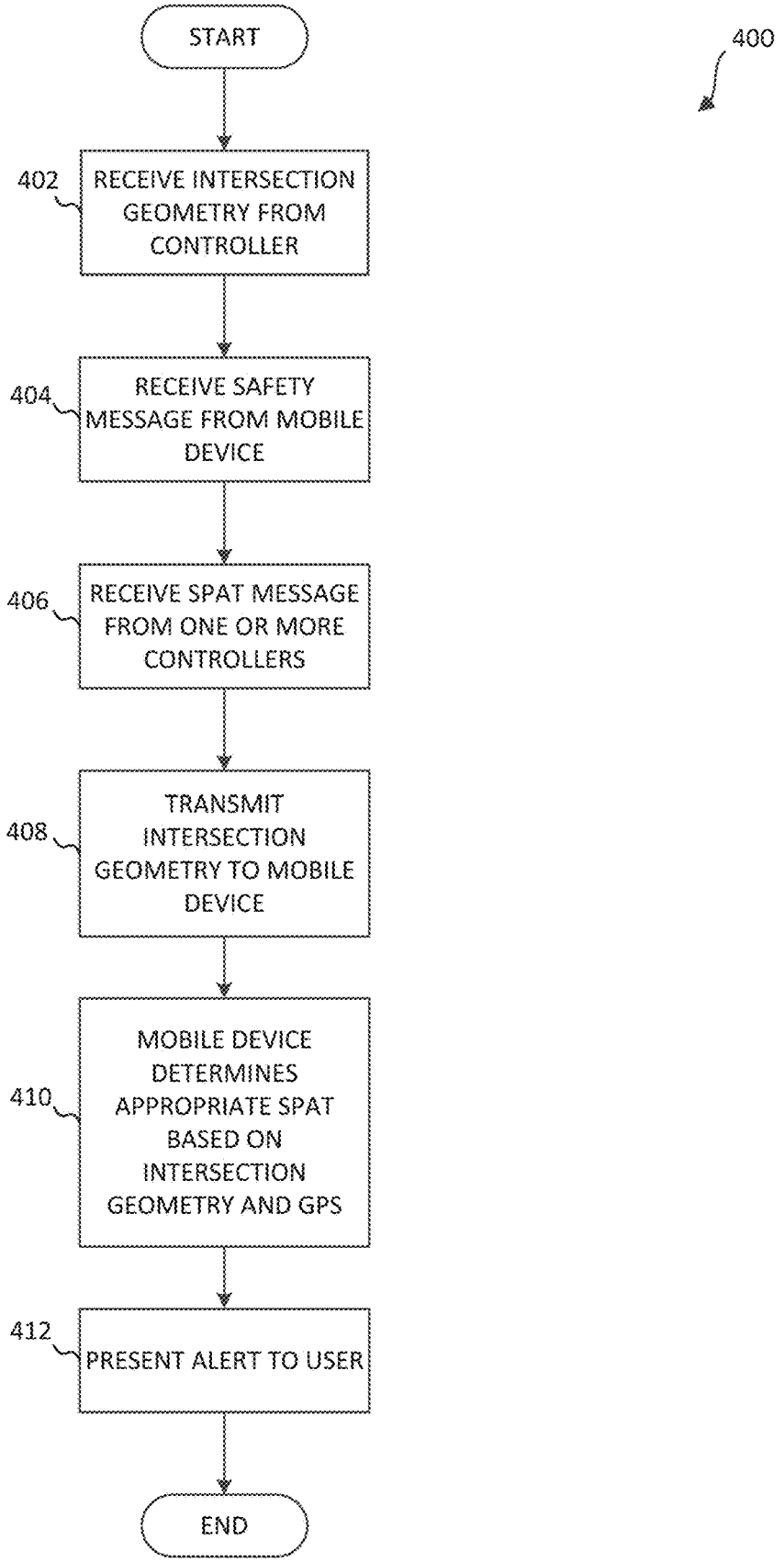
FIG. 4 is a flowchart illustrating an alert decision process, according to one aspect of the present disclosure.

Looking now at FIG. 4, a flowchart illustrating an alert decision process 400 is shown, according to one aspect of the present disclosure. In one embodiment, the process 400 generally includes presenting an alert to a user (e.g., a driver or pedestrian) based on data from MAP, SPAT, BSM, PSM, etc., type messages. In various embodiments, the alert is presented to the user via his/her mobile computing device and may inform the user about the status of a traffic light, how fast to drive in order to avoid stopping at the traffic light, the proximity of other nearby drivers or pedestrians, etc. In some embodiments, a cloud-based server included in the cellular network 106 may process at least a portion of these messages and act as an intermediary when determining if to transmit particular messages to either a traffic controller or mobile computing device. According to one aspect of the present disclosure, the process 400 begins at step 402, where the cloud-based server within the cellular network 106 receives intersection geometry (e.g., MAP message) corresponding to one or more traffic intersections. In some embodiments, MAP messages are received periodically from the traffic controllers, or the mobile computing devices may request MAP messages from the traffic controllers as necessary, such as during an initial configuration or system updates. In particular embodiments, the MAP messages may be manipulated, customized, or extended to include additional data for allowing a mobile computing device or built-in vehicle display to present a visual representation of the traffic signals. In some embodiments, the MAP message extensions may include parameters such as traffic light types (e.g., five signal section head) and lane counts. In various embodiments, extending the MAP message to include the traffic light types and lane counts allows for the mobile application, or built-in vehicle display, to illustrate the intersection and how the current state of the traffic lights corresponds to the lanes (e.g., left turning lanes are red but through lanes are green). In particular embodiments, the MAP messages may also be extended to include parameters which allow the receiving devices to present alerts such as "Get ready for green" and "Red light". These parameters may include data indicating when certain lights will change states, or the order in which certain lights change states (e.g., turning lanes are always red while through lanes are green).

At step 404, according to one aspect of the present disclosure, BSMs are transmitted by the automobiles or the mobile computing devices associated with the automobiles to the cloud-based server. According to various aspects of the present disclosure, PSMs (from pedestrians or bikers) may also be sent to the cloud-based server. In particular embodiments, receiving BSMs and/or PSMs allows for the cloud-based server to determine at least the location, speed, and direction of the automobiles and/or pedestrians for further transmitting data which may be used to service the users with relevant traffic alerts.

At step 406, one or more SPAT messages are transmitted to the cloud-based server from the one or more traffic controllers. According to various aspects of the present disclosure, there may be more than one traffic controller in close proximity to the automobile or pedestrian which transmitted the safety message from step 404. In certain embodiments, each traffic controller transmits its SPAT message to the cloud-based server, and the cloud-based server determines, based on received safety messages, to which devices to further transmit the SPAT information. As will be described below, the mobile device later decides which SPAT to use for presenting alerts to the user. In some embodiments, the system employs an event-driven SPAT technique, where the traffic intersection controller units 108 and/or the additional traffic equipment 220 only transmit or emanate their respective SPAT messages in response to an "event." Generally, in one embodiment, an event may include a light state change, or reaching a certain threshold on a signal timer, or any other event that may be of use for generating a traffic related alert. According to various aspects of the present disclosure, implementing an event-driven SPAT technique reduces strain on the cellular network 106, where constant or frequent transmission of SPAT messages introduces unnecessary signal traffic within the network 106 and occupies valuable network bandwidth.

At step 408, the intersection geometry is transmitted from the cloud-based server to the mobile computing device. In one embodiment, the MAP messages (e.g., intersection geometry) include an identifier or identification number indicating which intersection traffic controller the message was transmitted from, and also a timestamp representative of when the message was initially created or last modified. In certain embodiments, the most recent copies of the MAP messages may be stored locally at the mobile computing device or automobile computing system. Furthermore, and according to various aspects of the present disclosure, the SPAT messages transmitted from traffic controllers also include an identifier or identification number corresponding to the intersection the message was transmitted from. Upon receiving a SPAT message, the mobile computing device may query the traffic controller server with the received identification number for the MAP message at the server and further compare the timestamp of the queried MAP message with the locally stored MAP message. If the timestamps are not consistent, the mobile computing device may replace the locally stored MAP message with the more recent MAP message from the traffic controller server. In some embodiments, during initialization of the system and mobile application, each MAP message received by the mobile computing device may be the most recent MAP message and is furthermore locally stored.

According to various aspects of the present disclosure, MAP messages may be transmitted over cellular connections (or other connections such as internet, Bluetooth, RF, etc.) that are separate and independent from the connections used for communicating the BSM, PSM, and SPAT data. For example, in one embodiment, if a mobile computing device receives a SPAT message associated with an identification number corresponding to an intersection for which the mobile computing device does not have MAP data cataloged or stored, the mobile computing device may request or retrieve the appropriate MAP data from a database of MAP data. In various embodiments, this database may be stored local to the corresponding traffic controller unit, or the database may be remote (e.g., stored via the cloud-based server). In a particular embodiment, the MAP data may be accessed via a URL or other type of address (which may include at least a portion of the intersection identification number) for locating the MAP data in storage. In certain embodiments, allowing for the MAP data to be retrieved/accessed over a separate communication link than the BSM, PSM, and SPAT data reduces network traffic and bandwidth overloads, thus improving the overall efficiency of the system for presenting traffic alerts.

Proceeding now to step 410, the mobile computing device may determine the appropriate SPAT to process based at least on intersection geometry and GPS. In one embodiment, the logic within the mobile application includes instructions for comparing the GPS readings from the mobile computing device to the coordinates included in the intersection geometry. Furthermore, based on the GPS readings if it is determined that the automobile is heading in a particular direction towards one intersection and away from others, the SPAT messages relating to the other intersections may be disregarded. For example, consider a car driving down a city street. There may be a plurality of traffic lights within a 1000 ft. radius of the car, and the mobile device operatively running the mobile application for receiving traffic alerts may receive a SPAT message from each traffic controller associated with each of the plurality of traffic lights. In this scenario, the mobile computing device may determine that only one of the SPAT messages is relevant for presenting alerts based on the position, speed, and trajectory of the car compared to the coordinates included in the intersection geometry received for each of the corresponding SPAT messages. Accordingly, despite receiving a plurality of SPAT messages at the mobile computing device, the decision logic included in the mobile application determines the appropriate SPAT message to process for presenting traffic alerts to the user.

Continuing to step 412, in one embodiment, the remaining SPAT message from step 510 is used in conjunction with the corresponding MAP data for determining how to present alerts to the user. For example, upon determining that a particular SPAT message corresponds to the next traffic intersection that the particular user is approaching, the mobile computing device associated with the user will present the user with alerts that correspond with the current state of the light, the timing between next states, etc. For example, upon approaching a traffic light on a city street, the screen on the user's mobile device may display a visual indication of the traffic lights corresponding to each lane, such as turning lanes and thru lanes. Furthermore, in one embodiment, the mobile device may present the user with an audible alert based on the timing included in the SPAT message and corresponding to the next state of the light at the traffic intersection. For example, if the current state of the light is red and the user is currently stopped at the light, once the light is about to turn from red to green (e.g., 5 seconds), the mobile application may present the user with an audible "Get ready for green!" alert, thereby notifying the user to be prepared to take action.

Figure 5:
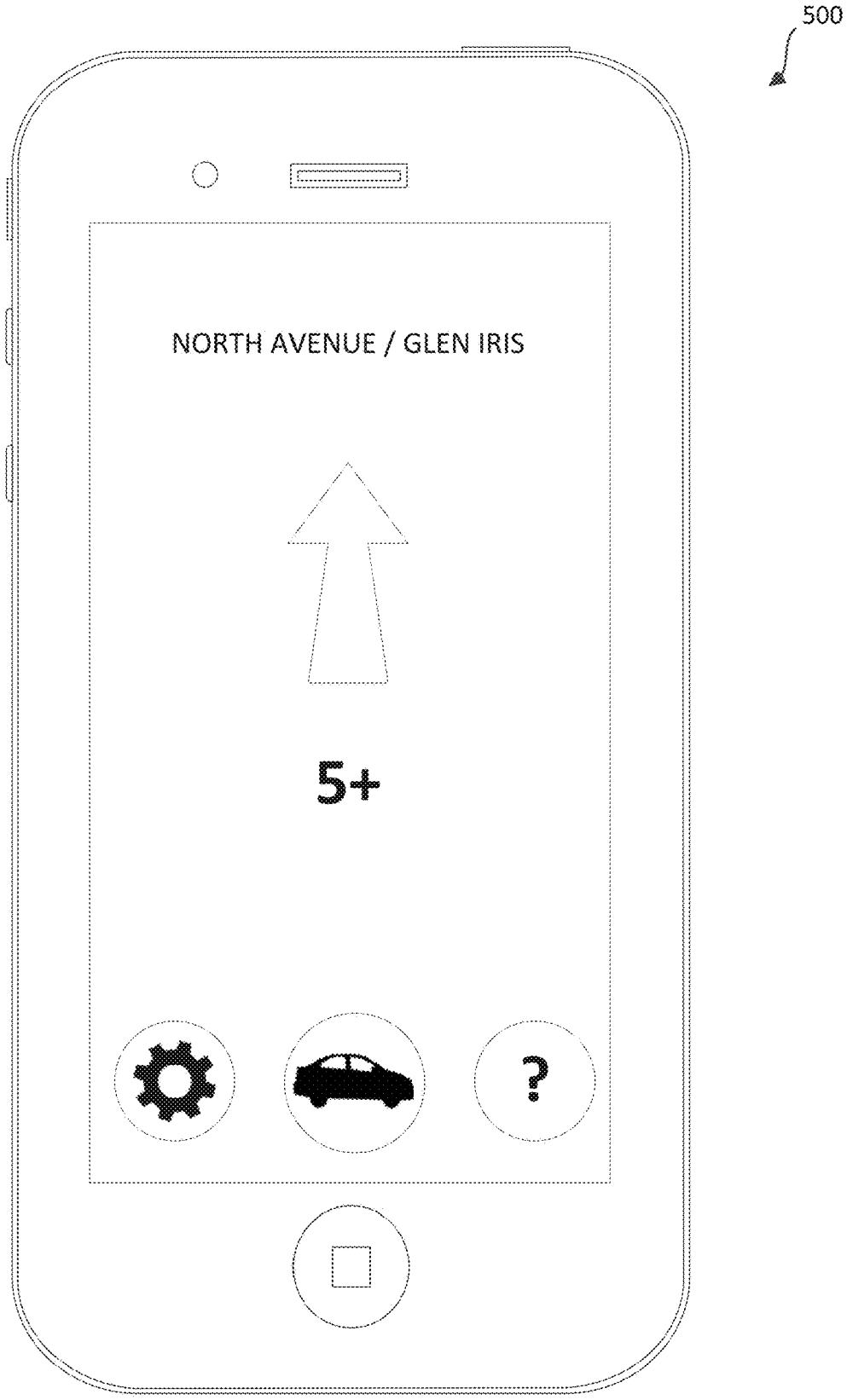
FIG. 5 is a screenshot of a mobile application illustrating a particular traffic light state, according to one aspect of the present disclosure.

Looking now at FIG. 5, a screenshot 500 of a mobile application illustrating a particular traffic light state is shown, according to one aspect of the present disclosure. In one embodiment, the mobile application may be operating in conjunction with a driver's mobile computing device (e.g., a smart phone) or the mobile application may be operating in conjunction with the built-in computing system within the driver's automobile. As shown in the present embodiment, a straight arrow is displayed with a timer (5+) shown underneath the arrow, and the arrow may be filled with color according to the current state of corresponding traffic light. According to various aspects of the present disclosure, this view of the mobile application may be presented to a driver upon approaching a particular traffic intersection where the current state of the traffic light is red but soon to turn green (as indicated by the timer). In some embodiments, if the traffic light will remain red (or green) for a substantially longer duration of time, such as 60 seconds, a timer showing 60+ may be displayed within the mobile application or no timer at all may be displayed. In various embodiments, the mobile application may generate an audible alert such as "Get ready for green," when the timer is soon to expire, thereby notifying the driver to pay attention to the light and prepare to operate his/her automobile.

Figure 6:
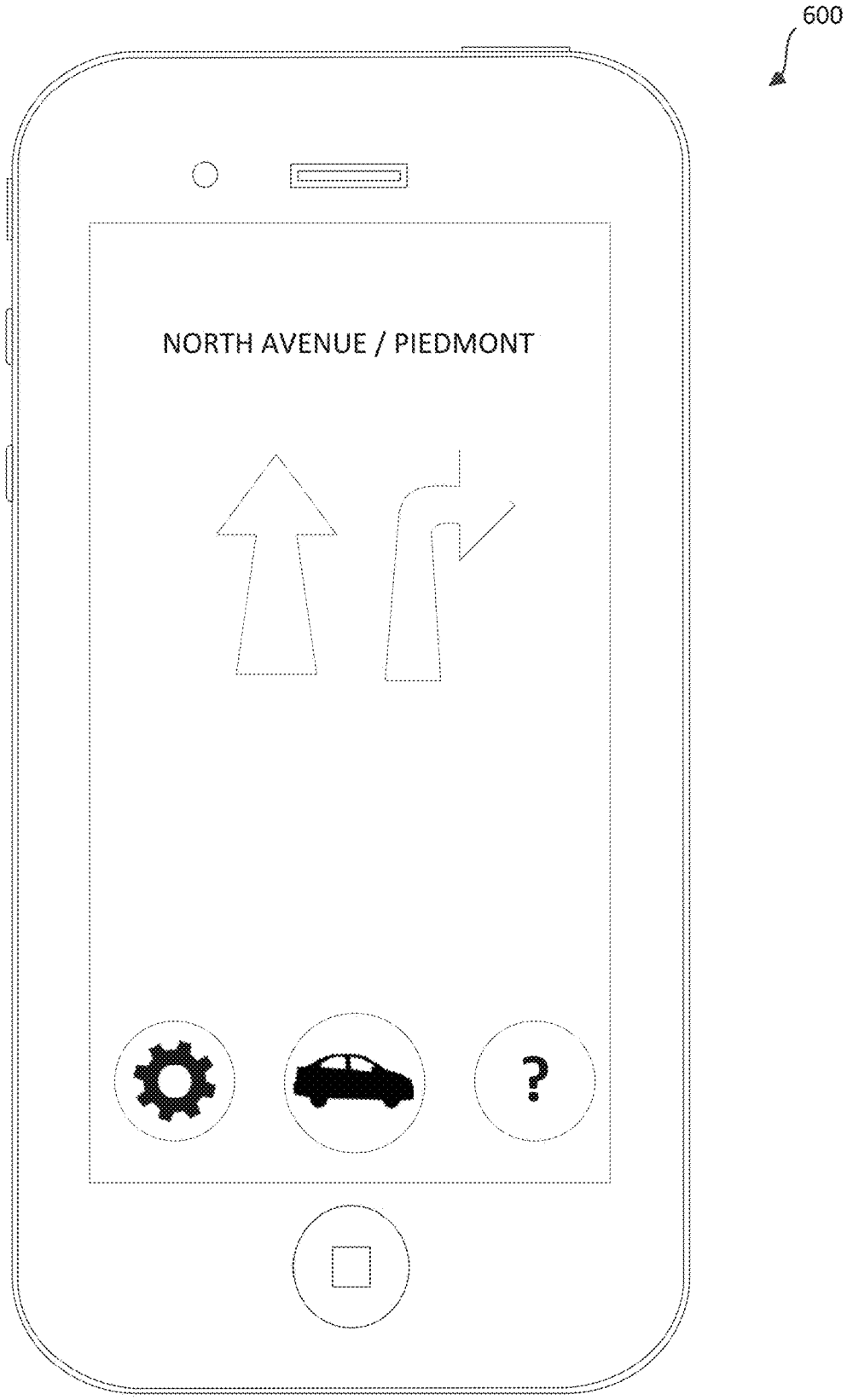
FIG. 6 is a screenshot of a mobile application illustrating a particular traffic light state, according to one aspect of the present disclosure.

In one embodiment, FIG. 6 is a screenshot 600 of a mobile application illustrating a particular traffic light state. As shown in the present embodiment, two arrows are displayed on the mobile application, a straight arrow and a right-curved arrow. In various embodiments, this view is displayed to a driver in response to the driver approaching a traffic intersection with multiple lane options. In particular embodiments, this view generally displays arrows corresponding to streets and the current states of the traffic lights controlling traffic flow onto those streets. It should be understood that any combination of lights and arrows corresponding to traffic lanes may be displayed within the mobile application, and the combination of lights and arrows may change in response to a change in state at the traffic light controller.

Figure 7:
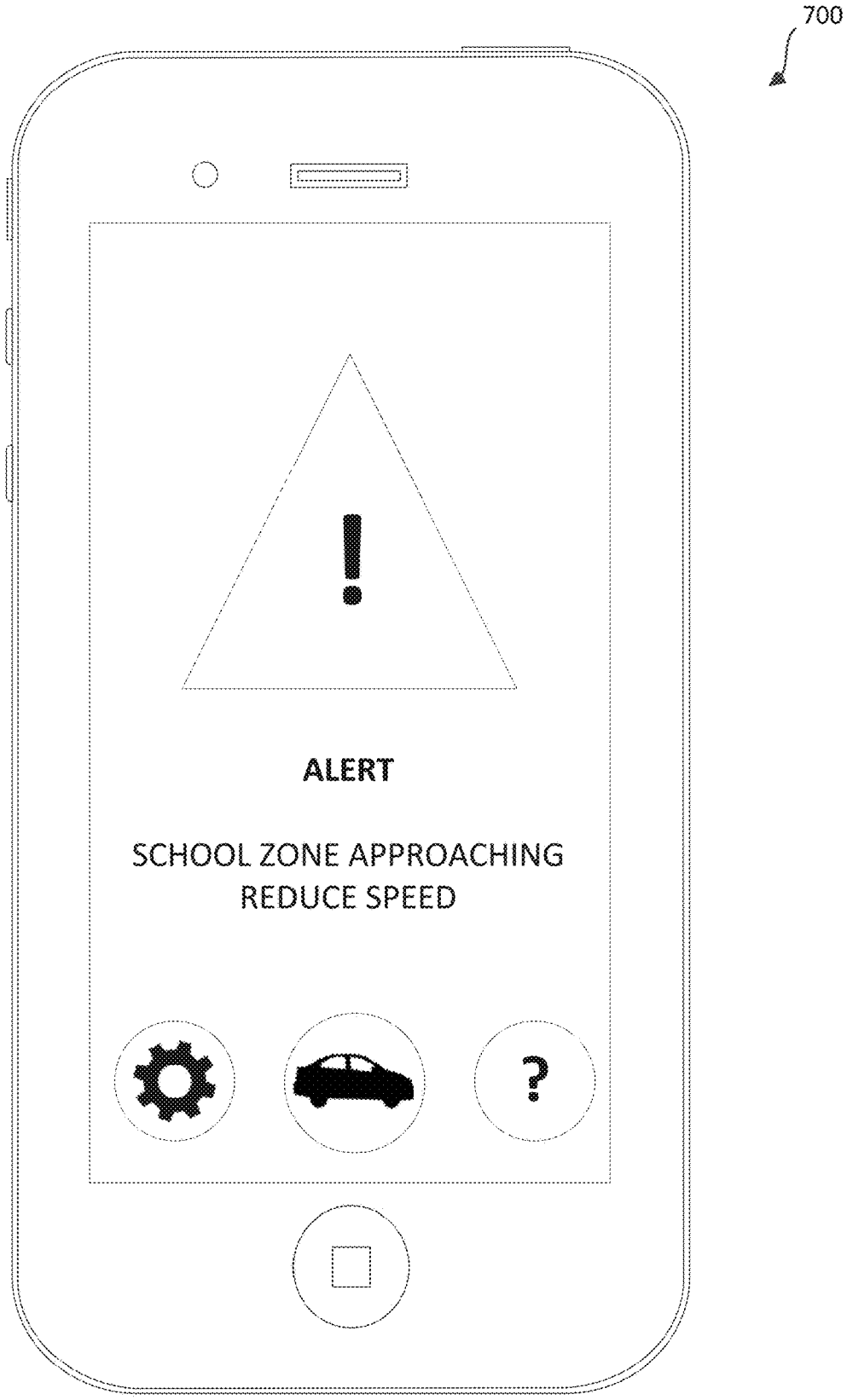
FIG. 7 is a screenshot of a mobile application illustrating a particular traffic-related alert, according to one aspect of the present disclosure.
Figure 8:
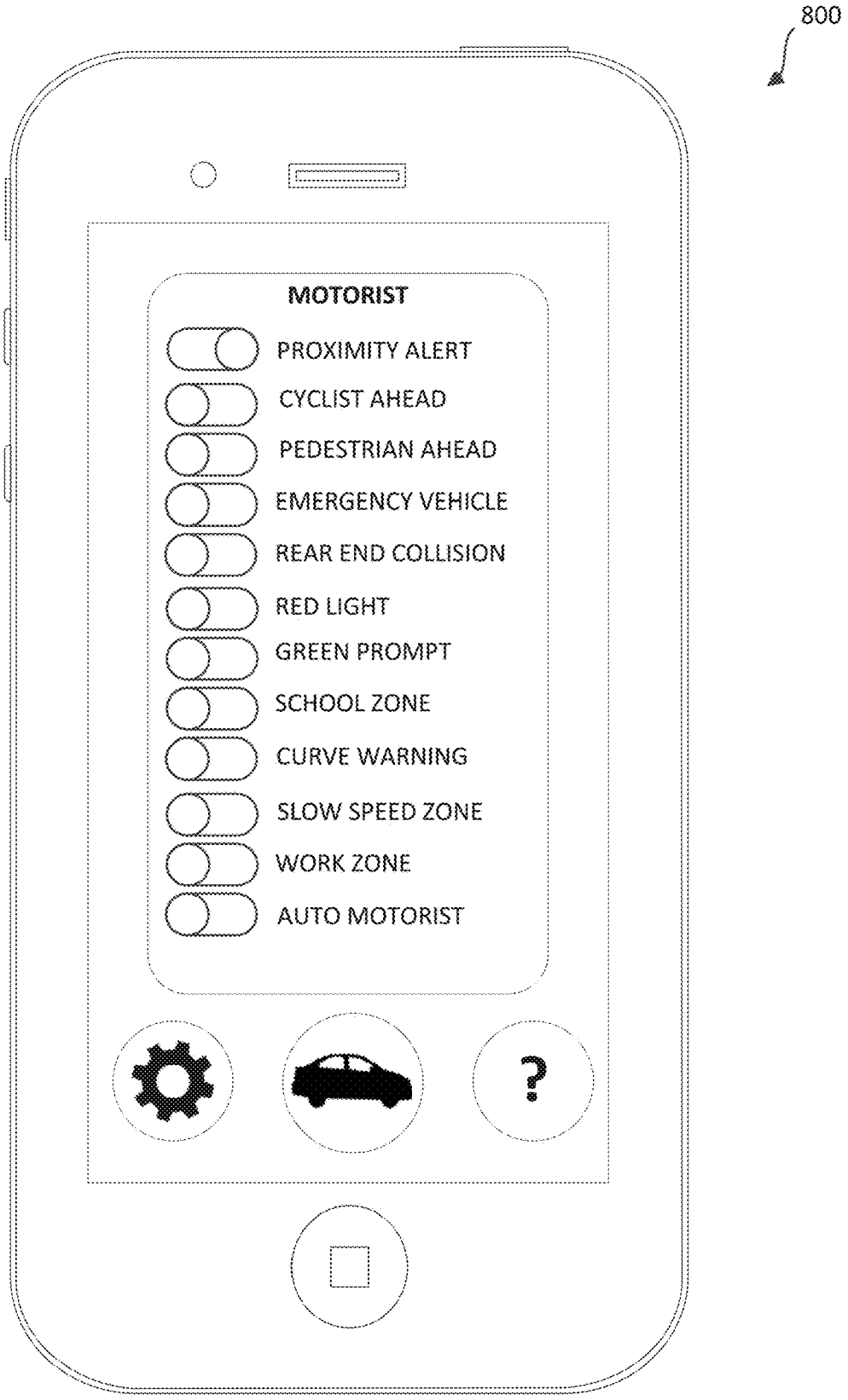
FIG. 8 is a screenshot of a mobile application illustrating particular configuration options, according to one aspect of the present disclosure.
Figure 9:
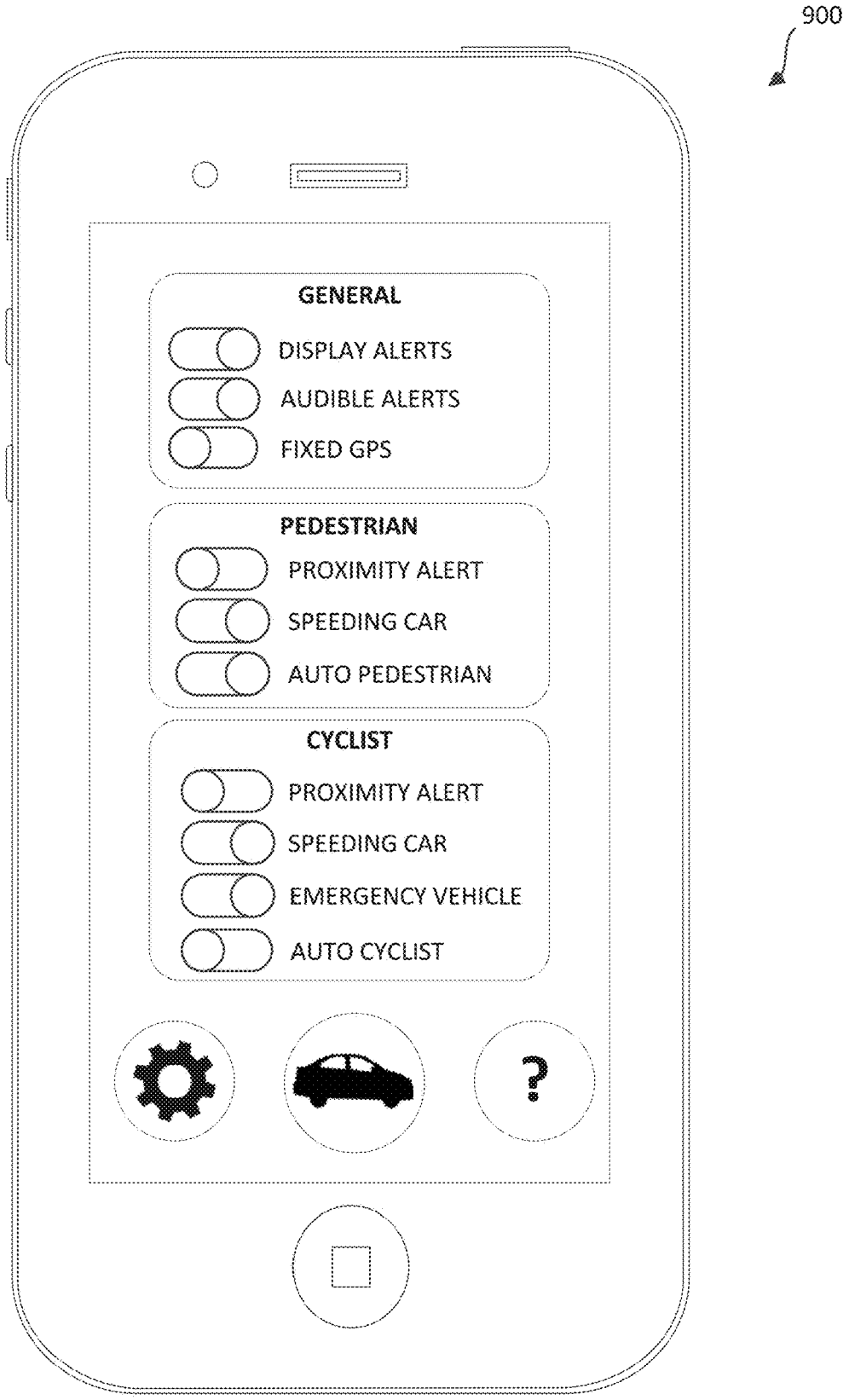
FIG. 9 is a screenshot of a mobile application illustrating particular configuration options, according to one aspect of the present disclosure.

FIG. 7 is a screenshot 700 of a particular alert on a mobile application, according to one aspect of the present embodiment. In some embodiments, an alert such as the alert shown in the present embodiment may be presented to a driver when he/she is driving over the speed limit in a geographical location classified as a school zone. In various embodiments, the user's mobile device may transmit the GPS location of the driver (included in a BSM) to a traffic light/traffic controller or beacon in the school zone, which in turn may transmit data back to the mobile device (via SPAT and/or MAP data) indicating that the area is a school zone. In response to receiving the data from the traffic light/traffic controller or beacon, the mobile device may present the driver with the alert shown in the present embodiment if the driver is exceeding the speed limit for the particular school zone. According to various embodiments, these and other aspects may be configured by the user in a settings/configurations menu, such as those shown in the embodiments of FIGS. 8-9.

Exemplary Embodiments

According to various aspects of the present disclosure, the system described herein may be implemented in various environments and scenarios. For example, the system may be implemented to provide users notifications relating to school zones and the appropriate speed for traveling therein, work zones and the appropriate speed for traveling therein, stopped school buses, occupied railroad crossings, nearby/approaching emergency vehicles, high accident areas, etc. In further embodiments, the system may present the user notifications if it is determined, via GPS location, that the user is travelling the wrong direction on a one way roadway, if the user is approaching a stop sign or occupied crosswalk at a speed that is not indicative of an intent to stop, etc.

Exemplary Architecture

From the foregoing, it will be understood that various aspects of the processes described herein are software processes that execute on computer systems that form parts of the system. Accordingly, it will be understood that various embodiments of the system described herein are generally implemented as specially-configured computers including various computer hardware components and, in many cases, significant additional features as compared to conventional or known computers, processes, or the like, as discussed in greater detail herein. Embodiments within the scope of the present disclosure also include computer-readable media for carrying or having computer-executable instructions or data structures stored thereon. Such computer-readable media can be any available media which can be accessed by a computer, or downloadable through communication networks. By way of example, and not limitation, such computer-readable media can comprise various forms of data storage devices or media such as RAM, ROM, flash memory, EEPROM, CD-ROM, DVD, or other optical disk storage, magnetic disk storage, solid state drives (SSDs) or other data storage devices, any type of removable nonvolatile memories such as secure digital (SD), flash memory, memory stick, etc., or any other medium which can be used to carry or store computer program code in the form of computer-executable instructions or data structures and which can be accessed by a general purpose computer, special purpose computer, specially-configured computer, mobile device, etc.

When information is transferred or provided over a network or another communications connection (either hardwired, wireless, or a combination of hardwired or wireless) to a computer, the computer properly views the connection as a computer-readable medium. Thus, any such a connection is properly termed and considered a computer-readable medium. Combinations of the above should also be included within the scope of computer-readable media. Computer-executable instructions comprise, for example, instructions and data which cause a general purpose computer, special purpose computer, or special purpose processing device such as a mobile device processor to perform one specific function or a group of functions.

Those skilled in the art will understand the features and aspects of a suitable computing environment in which aspects of the disclosure may be implemented. Although not required, some of the embodiments of the claimed systems may be described in the context of computer-executable instructions, such as program modules or engines, as described earlier, being executed by computers in networked environments. Such program modules are often reflected and illustrated by flow charts, sequence diagrams, exemplary screen displays, and other techniques used by those skilled in the art to communicate how to make and use such computer program modules. Generally, program modules include routines, programs, functions, objects, components, data structures, application programming interface (API) calls to other computers whether local or remote, etc. that perform particular tasks or implement particular defined data types, within the computer. Computer-executable instructions, associated data structures and/or schemas, and program modules represent examples of the program code for executing steps of the methods disclosed herein. The particular sequence of such executable instructions or associated data structures represent examples of corresponding acts for implementing the functions described in such steps.

Those skilled in the art will also appreciate that the claimed and/or described systems and methods may be practiced in network computing environments with many types of computer system configurations, including personal computers, smartphones, tablets, hand-held devices, multiprocessor systems, microprocessor-based or programmable consumer electronics, networked PCs, minicomputers, mainframe computers, and the like. Embodiments of the claimed system are practiced in distributed computing environments where tasks are performed by local and remote processing devices that are linked (either by hardwired links, wireless links, or by a combination of hardwired or wireless links) through a communications network. In a distributed computing environment, program modules may be located in both local and remote memory storage devices.

An exemplary system for implementing various aspects of the described operations, which is not illustrated, includes a computing device including a processing unit, a system memory, and a system bus that couples various system components including the system memory to the processing unit. The computer will typically include one or more data storage devices for reading data from and writing data to. The data storage devices provide nonvolatile storage of computer-executable instructions, data structures, program modules, and other data for the computer.

Computer program code that implements the functionality described herein typically comprises one or more program modules that may be stored on a data storage device. This program code, as is known to those skilled in the art, usually includes an operating system, one or more application programs, other program modules, and program data. A user may enter commands and information into the computer through keyboard, touch screen, pointing device, a script containing computer program code written in a scripting language or other input devices (not shown), such as a microphone, etc. These and other input devices are often connected to the processing unit through known electrical, optical, or wireless connections.

The computer that effects many aspects of the described processes will typically operate in a networked environment using logical connections to one or more remote computers or data sources, which are described further below. Remote computers may be another personal computer, a server, a router, a network PC, a peer device or other common network node, and typically include many or all of the elements described above relative to the main computer system in which the systems are embodied. The logical connections between computers include a local area network (LAN), a wide area network (WAN), virtual networks (WAN or LAN), and wireless LANs (WLAN) that are presented here by way of example and not limitation. Such networking environments are commonplace in office-wide or enterprise-wide computer networks, intranets, and the Internet.

When used in a LAN or WLAN networking environment, a computer system implementing aspects of the system is connected to the local network through a network interface or adapter. When used in a WAN or WLAN networking environment, the computer may include a modem, a wireless link, or other mechanisms for establishing communications over the wide area network, such as the Internet. In a networked environment, program modules depicted relative to the computer, or portions thereof, may be stored in a remote data storage device. It will be appreciated that the network connections described or shown are exemplary and other mechanisms of establishing communications over wide area networks or the Internet may be used.

While various aspects have been described in the context of a preferred embodiment, additional aspects, features, and methodologies of the claimed systems will be readily discernible from the description herein, by those of ordinary skill in the art. Many embodiments and adaptations of the disclosure and claimed systems other than those herein described, as well as many variations, modifications, and equivalent arrangements and methodologies, will be apparent from or reasonably suggested by the disclosure and the foregoing description thereof, without departing from the substance or scope of the claims. Furthermore, any sequence(s) and/or temporal order of steps of various processes described and claimed herein are those considered to be the best mode contemplated for carrying out the claimed systems. It should also be understood that, although steps of various processes may be shown and described as being in a preferred sequence or temporal order, the steps of any such processes are not limited to being carried out in any particular sequence or order, absent a specific indication of such to achieve a particular intended result. In most cases, the steps of such processes may be carried out in a variety of different sequences and orders, while still falling within the scope of the claimed systems. In addition, some steps may be carried out simultaneously, contemporaneously, or in synchronization with other steps.

CONCLUSION

Aspects, features, and benefits of the claimed embodiment (s) will become apparent from the information disclosed in the exhibits and the other applications as incorporated by reference. Variations and modifications to the disclosed systems and methods may be effected without departing from the spirit and scope of the novel concepts of the disclosure.

It will, nevertheless, be understood that no limitation of the scope of the disclosure is intended by the information disclosed in the exhibits or the applications incorporated by reference; any alterations and further modifications of the described or illustrated embodiments, and any further applications of the principles of the disclosure as illustrated therein are contemplated as would normally occur to one skilled in the art to which the disclosure relates.

The foregoing description of the exemplary embodiments has been presented only for the purposes of illustration and description and is not intended to be exhaustive or to limit the claimed embodiments to the precise forms disclosed. Many modifications and variations are possible in light of the above teaching.

The embodiments were chosen and described in order to explain the principles of the claimed embodiments and their practical application so as to enable others skilled in the art to utilize the claimed embodiments and various embodiments and with various modifications as are suited to the particular use contemplated. Alternative embodiments will become apparent to those skilled in the art to which the present embodiments pertain without departing from their spirit and scope. Accordingly, the scope of the present embodiments is defined by the appended claims rather than the foregoing description and the exemplary embodiments described therein.

What is claimed is:

1. A system comprising:

a cloud-based server, wherein the cloud-based sever comprises at least one processor; and a plurality of traffic controller units, wherein each of the plurality of traffic controller units controls at least one traffic signaling device of a plurality of traffic signaling devices, and wherein each of the plurality of traffic controller units are operatively configured to transmit signal, phase, and timing (SPAT) messages to the cloud-based server only in response to receiving or detecting a traffic state event comprising a change to a traffic signaling status at each respective at least one traffic signaling device, wherein the SPAT messages comprise traffic light state data indicative of the change to the traffic signaling status, as well as a traffic intersection identifier corresponding to a traffic intersection at which each respective at least one traffic signaling device is located, wherein in response to receiving the SPAT messages, the cloud-based server is operatively configured to transmit a subset of the SPAT messages to each electronic computing device of a plurality of electronic computing devices based on device location data previously received from the plurality of electronic computing devices, wherein each electronic computing device of the plurality of electronic computing devices is operatively configured to determine a respective relevant SPAT message from the subset of SPAT messages, wherein the respective relevant SPAT message corresponds to a particular traffic intersection towards which its corresponding electronic computing device is determined to be approaching, wherein determining the particular traffic intersection towards which the corresponding electronic computing device is approaching comprises comparing, via the corresponding electronic computing device, the electronic computing device's geographic location and movement data to geographic coordinates of a plurality of traffic intersections stored at the corresponding electronic computing device to determine a particular set of coordinates physically and directionally proximate to the electronic computing device, and wherein determining the respective relevant SPAT message from the subset of SPAT messages comprises determining that the respective relevant SPAT message and the particular set of coordinates comprise matching traffic intersection identifiers.

2. The system of claim 1, wherein the change to the traffic signaling status at each respective at least one traffic signaling device comprises a change to a present or future state of a light at each respective at least one traffic signaling device, or exceeding a predetermined signal timer at each respective at least one traffic signaling device, wherein the predetermined signal timer corresponds to a particular traffic light state.

3. The system of claim 1, wherein each of the plurality of traffic controller units are located physically proximate to each respective at least one traffic signaling device of the plurality of traffic signaling devices.

4. The system of claim 1, wherein each of the plurality of electronic computing devices is associated with a vehicle and/or individual, and wherein the plurality of electronic computing devices are operable to transmit travel-related information messages corresponding to a respective vehicle and/or individual to the cloud-based server.

5. The system of claim 4, wherein the travel-related information messages comprise data relating to a past and/or current traffic-related activity of a vehicle, and wherein the data comprises vehicle position, speed, heading, acceleration, vehicle size, vehicle mass, steering wheel angle, braking data, the device location data, and associated time stamps.

6. The system of claim 4, wherein the travel-related information messages comprise data relating to a past and/or current traffic-related activity of a pedestrian, and wherein the data comprises position, speed, heading, acceleration, the device location data, and associated time stamps.

7. The system of claim 1, wherein the set of coordinates corresponding to the particular traffic intersection are based at least on intersection data stored at each electronic computing device of the plurality of electronic computing devices, and wherein the intersection data comprises intersection geometry for generating traffic-related alerts at the plurality of electronic computing devices.

8. The system of claim 1, wherein the SPAT messages comprise a future or current status of each respective at least one traffic signaling device.

9. A method comprising the steps of:

detecting, at a processor operatively connected to a traffic controller unit configured to control at least one traffic signaling device of a plurality of traffic signaling devices, a traffic state event comprising a change to a traffic signaling status at the at least one traffic signaling device; and transmitting to a cloud-based server, and only in response to detecting the change to the traffic signaling status at the at least one traffic signaling device, a signal, phase, and timing (SPAT) message comprising traffic light state data indicative of the change to the traffic signaling status and a traffic intersection identifier corresponding to a traffic intersection at which each respective at least one traffic signaling device is located, wherein the cloud-based server includes a plurality of SPAT messages received from a plurality of traffic controller units configured to control the plurality of traffic signaling devices, wherein in response to receiving the SPAT message, the cloud-based server is operatively configured to compare the SPAT message and the plurality of SPAT messages to device location data received from a plurality of electronic computing devices to determine a subset of SPAT messages to transmit to each electronic computing device of the plurality of electronic computing devices, wherein each electronic computing device of the plurality of electronic computing devices is operatively configured to determine a respective relevant SPAT message from the subset of SPAT messages, wherein the respective relevant SPAT message corresponds to a particular traffic intersection towards which its corresponding electronic computing device is determined to be approaching, wherein determining the particular traffic intersection towards which the corresponding electronic computing device is approaching comprises comparing, via the corresponding electronic computing device, the electronic computing device's geographic location and movement data to geographic coordinates of a plurality of traffic intersections stored at the corresponding electronic computing device to determine a particular set of coordinates physically and directionally proximate to the electronic computing device, and wherein determining the respective relevant SPAT message from the subset of SPAT messages comprises determining that the respective relevant SPAT message and the particular set of coordinates comprise matching traffic intersection identifiers.

10. The method of claim 9, wherein the change to the traffic signaling status at the at least one traffic signaling device comprises a change to a present or future state of a light at the at least one traffic signaling device, or exceeding a predetermined signal timer at the at least one traffic signaling device, wherein the predetermined signal timer corresponds to a particular traffic light state.

11. The method of claim 9, wherein the traffic controller unit is located physically proximate to the at least one traffic signaling device.

12. The method of claim 9, wherein each electronic computing device of the plurality of electronic computing devices is operable to transmit travel-related information messages corresponding to a respective vehicle and/or individual to the cloud-based server.

13. The method of claim 12, wherein the travel-related information messages comprise data relating to a past and/or current traffic-related activity of a vehicle, and wherein the data comprises vehicle position, speed, heading, acceleration, vehicle size, vehicle mass, steering wheel angle, braking data, the device location data, and associated time stamps.

14. The method of claim 12, wherein the travel-related information messages comprise data relating to a past and/or current traffic-related activity of a pedestrian, and wherein the data comprises position, speed, heading, acceleration, the device location data, and associated time stamps.

15. The method of claim 9, wherein the set of coordinates corresponding to the particular traffic intersection are based at least on intersection data stored at each electronic computing device of the plurality of electronic computing devices, and wherein the intersection data comprises intersection geometry for generating traffic-related alerts at the plurality of electronic computing devices.

16. The method of claim 9, wherein the SPAT message comprises a future or current status of the at least one traffic signaling device.

* * * * *